US007972760B2

(12) United States Patent
Murai et al.

(10) Patent No.: US 7,972,760 B2
(45) Date of Patent: Jul. 5, 2011

(54) ELECTROPHOTOGRAPHIC IMAGE RECEIVING SHEET AND IMAGE FORMING METHOD USING THE SAME

(75) Inventors: Ashita Murai, Kanagawa (JP); Shinji Fujimoto, Shizuoka (JP); Yasutomo Goto, Shizuoka (JP); Yoshio Tani, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 12/594,872

(22) PCT Filed: Apr. 8, 2008

(86) PCT No.: PCT/JP2008/056937

§ 371 (c)(1),
(2), (4) Date: Oct. 6, 2009

(87) PCT Pub. No.: WO2008/126839

PCT Pub. Date: Oct. 23, 2008

(65) Prior Publication Data

US 2010/0129747 A1 May 27, 2010

(30) Foreign Application Priority Data

Apr. 10, 2007 (JP) ..... 2007-103171

(51) Int. Cl.
*G03G 5/00* (2006.01)

(52) U.S. Cl. ..... 430/124.53; 430/124.54; 428/480

(58) Field of Classification Search ..... 430/124.53, 430/124.54; 428/480
See application file for complete search history.

(56) References Cited

U.S. PATENT DOCUMENTS 6,051,355 A * 4/2000 Van Thillo et al. ..... 430/109.4

FOREIGN PATENT DOCUMENTS

| | | | |
|---|---|---|---|
| JP | 2004-233518 | A | 8/2004 |
| JP | 2005-92097 | A | 4/2005 |
| JP | 2005-99123 | A | 4/2005 |
| JP | 2005-181881 | A | 7/2005 |
| JP | 2005-181883 | A | 7/2005 |
| JP | 2005-283654 | A | 10/2005 |
| JP | 2007-57718 | A | 3/2007 |

* cited by examiner

*Primary Examiner* — Mark A Chapman
(74) *Attorney, Agent, or Firm* — Sughrue Mion, PLLC

(57) ABSTRACT

The present invention provides an electrophotographic image receiving sheet including a support, and at least two toner image receiving layers formed over at least one surface of the support, wherein a mixture mass ratio M of a crystalline polymer and an amorphous polymer in each of the toner image receiving layers is defined as [A/(A+B)], where A represents a mass of the crystalline polymer (g), and B represents a mass of the amorphous polymer (g), and a mixture mass ratio M1 of the outermost toner image receiving layer which is located farthest from the support, and a mixture mass ratio M2 of the highest inner toner image receiving layer, which has the highest mixture mass ratio among the inner toner image receiving layers located under the outermost toner image receiving layer, satisfy the relation: M1<M2.

11 Claims, 2 Drawing Sheets

ELECTROPHOTOGRAPHIC IMAGE RECEIVING SHEET AND IMAGE FORMING METHOD USING THE SAME

BACKGROUND OF THE INVENTION

1. Technical Field

The present invention relates to an electrophotographic image receiving sheet having excellent low temperature fixing property and excellent adhesion resistance, capable of forming a highly glossy and high-quality image similar to that of silver halide photography, and an image forming method using the electrophotographic image receiving sheet, which exhibits excellent passing performance in a fixing device, and can prevent occurrence of running failure such as jam, double feed in an image forming apparatus.

2. Background Art

Since electrophotography, which is a dry processing, is excellent in printing speed and able to output an image on general-use paper such as plain paper and fine paper, it has been widely used in copiers and output devices used in personal computers.

Recently, in order to achieve high image quality in electrophotography, which quality is similar to that of silver halide photography, when image information of face, landscape and the like is output as a photograph, an electrophotographic image receiving sheet has been used as paper for exclusive use. Such electrophotographic image receiving sheet includes at least a toner image receiving layer formed on a support, and the toner image receiving layer is formed, for example, by a method in which a thermoplastic-resin containing composition is melted and extruded on the support so as to form a lamination thereon, a method in which a thermoplastic-resin containing coating solution is coated on the support or the like.

Thermoplastic resins used for the toner image receiving layer usually include amorphous polymers, the glass transition temperature (Tg) of which is higher than an environmental temperature and in a temperature range lower by several dozen degrees than a toner fixable temperature. These amorphous polymers are excellent in adhesiveness to toner but are also high in adhesive force between toner image receiving layers containing the toner. Thus, there is a problem that in the case where a toner image receiving layer of an electrophotographic image receiving sheet faces and superposes a back surface of another electrophotographic image receiving sheet during storage and transportation thereof, the toner image receiving layer of the electrophotographic image receiving sheet adheres to the back surface of another electrophotographic image receiving sheet, causing running failure such as jam, double feed, and the like.

On the other hand, crystalline polymers have low adhesive force even when the glass transition temperature (Tg) thereof is in a temperature range of below-zero, and the adhesion failure between the toner image receiving layer of one electrophotographic image receiving sheet and the back surface of another electrophotographic image receiving sheet does not occur. However, there is a problem that the crystalline polymers have insufficient adherence to toner, causing toner removal from the toner image receiving layers on which the toner has been fixed.

In order to solve the problem, there has been proposed an electrophotographic image receiving sheet in which, for example, a toner image receiving layer contains a mixture of a linear amorphous polymer with a linear crystalline polymer, a glass transition temperature (Tg1 (° C.)) of the linear amorphous polymer is 40° C. to 120° C. and a melting point (Tm (° C.)) of the linear crystalline polymer is 100° C. to 200° C. (see Patent Literature 1).

Further, there has been proposed an electrophotographic image receiving sheet in which a toner image receiving layer contains a mixture of a linear amorphous polymer with a linear crystalline polymer, and a glass transition temperature (Tg1) of the linear amorphous polymer and a melting point (Tm) of the linear crystalline polymer satisfy the relation of the following formula: (Tg1−20° C.)≦Tm≦(Tg1+20° C.), and also the Tg1 is in a range from 40° C. to 120° C. (see Patent Literature 2).

According to these proposals, it is possible to solve the problems of amorphous polymers and crystalline polymers, and to achieve both favorable toner fixing property and excellent adhesion resistance, thereby forming a highly glossy and high-quality image.

However, in these proposals, a solution prepared by dissolving the mixture of the linear amorphous polymer with the linear crystalline polymer in an organic solvent is used, causing a serious impact on the environment. Further, in the above proposals, a highly glossy image is obtained when a fixing temperature is high, for example, approximately 155° C. However, when the fixing temperature is lowered, there occur defects such as a decreased gloss and uneven gloss occurring on a boundary line between an image portion and a non-image portion. Therefore, when the fixing temperature is lowered for the purpose of saving energy, only an unpleasant image is obtained which is inferior in uniformity. Moreover, all of these prior arts disclose the toner image receiving layers having single layer structures, and it has been difficult to satisfy both excellent low temperature fixing property and excellent adhesion resistance in the toner image receiving layers having single layer structures.

There has also been proposed a medium to be transferred for a color electrophotographic image having a toner image receiving layer formed of a crystalline polyester resin in which an aromatic dicarboxylic acid component is contained as an acid-derived component and straight-chain aliphatic diol, bisphenol S, or bisphenol S alkylene oxide additive is contained as an alcohol derived component (see Patent Literature 3).

Moreover, there has been proposed an image support material in which a thermoplastic resin of a toner image receiving layer is formed of a polyester resin prepared by melting and mixing a crystalline polyester resin and an amorphous polyester resin and a viscosity of $10^3$ Pa·s is obtained at a temperature from 80° C. to 110° C. (see Patent Literature 4).

However, in these proposals, there is a problem that the toner image receiving layers have single layer structures, and are hard to satisfy both excellent low temperature fixing property and excellent adhesion resistance, and that the toner image receiving layer is not formed by a coating method but is formed by a melt extrusion method, which requires expensive production facilities and an increased quantity of energy, resulting in an increased production cost, a greater impact on the environment and a poor quality of the gloss.

Under these circumstances, there has not yet been provided an electrophotographic image receiving sheet having a satisfiable performance, such as excellent low temperature fixing property and excellent adhesion resistance, capable of forming a highly glossy and high-quality image similar to that of silver halide photography, and an image forming method using the electrophotographic image receiving sheet, which exhibits excellent passing performance in a fixing device, and can prevent occurrence of running failure such as jam, double feed in an image forming apparatus. At present, the prompt provision thereof is demanded.

Patent Literature 1: Japanese Patent Application Laid-Open (JP-A) No. 2005-181881

Patent Literature 2: JP-A No. 2005-181883

Patent Literature 3: JP-A No. 2005-92097

Patent Literature 4: JP-A No. 2005-99123

DISCLOSURE OF INVENTION

An object of the present invention is to provide an electrophotographic image receiving sheet having excellent low temperature fixing property and excellent adhesion resistance, capable of forming a highly glossy and high-quality image similar to that of silver halide photography, and an image forming method using the electrophotographic image receiving sheet, which exhibits excellent passing performance in a fixing device, and can prevent occurrence of running failure such as jam, double feed in an image forming apparatus.

Means for solving the problems are as follows:

<1> An electrophotographic image receiving sheet including a support, and at least two toner image receiving layers formed over at least one surface of the support, wherein a mixture mass ratio M of a crystalline polymer and an amorphous polymer in each of the toner image receiving layers is defined as [A/(A+B)], where A represents a mass of the crystalline polymer (g), and B represents a mass of the amorphous polymer (g), and a mixture mass ratio M1 of the outermost toner image receiving layer which is located farthest from the support, and a mixture mass ratio M2 of the highest inner toner image receiving layer, which has the highest mixture mass ratio among the inner toner image receiving layers located under the outermost toner image receiving layer, satisfy the relation: M1<M2.

<2> The electrophotographic image receiving sheet according to <1>, wherein the mixture mass ratio M1 of the outermost toner image receiving layer is 0.4 or less.

<3> The electrophotographic image receiving sheet according to any one of <1> and <2>, wherein in the case where the toner image receiving layers have a two layer structure, in which a second toner image receiving layer is formed on the support and a first toner image receiving layer is formed on the second toner image receiving layer, the mixture mass ratio M1 of the first toner image receiving layer and a mixture mass ratio M2 of the second toner image receiving layer satisfy the relation: M1<M2.

<4> The electrophotographic image receiving sheet according to any one of claims <1> and <2>, wherein in the case where the toner image receiving layers have a three layer structure, in which a third toner image receiving layer is formed on the support, a second toner image receiving layer is formed on the third toner image receiving layer and a first toner image receiving layer is formed on the second toner image receiving layer, the mixture mass ratio M1 of the first toner image receiving layer, a mixture mass ratio M2 of the second toner image receiving layer and a mixture mass ratio M3 of a third toner image receiving layer satisfy the relation: M1<M2 or M1<M3 (where M1 is smaller than any one of M2 and M3, whichever larger).

<5> The electrophotographic image receiving sheet according to any one of <1> to <4>, wherein the toner image receiving layer is formed of a coating solution for the toner image receiving layer, which contains at least any one of a crystalline polymer aqueous dispersion containing at least the crystalline polymer and an amorphous polymer aqueous dispersion containing at least the amorphous polymer.

<6> The electrophotographic image receiving sheet according to any one of <1> to <5>, wherein the crystalline polymer is a crystalline polyester resin and the amorphous polymer is an amorphous polyester resin.

<7> The electrophotographic image receiving sheet according to <6>, wherein the polyester resin is a carboxyl group-containing self-dispersible polyester resin.

<8> The electrophotographic image receiving sheet according to any one of <1> to <7>, wherein the support contains a raw paper, and at least one polyolefin resin layer formed on both surfaces of the raw paper.

<9> The electrophotographic image receiving sheet according to any one of <1> to <8>, wherein the electrophotographic image receiving sheet further includes an intermediate layer formed between the support and the toner image receiving layers, and the intermediate layer contains a polymer for the intermediate layer, which has a glass transition temperature equal to or lower than a temperature for fixing an image.

<10> An image forming method including forming a toner image on the electrophotographic image receiving sheet according to any one of <1> to <9>, and smoothing and fixing a surface of the toner image formed on the electrophotographic image receiving sheet.

<11> The image forming method according to <10>, wherein the smoothing and fixing is heating and pressurizing, and cooling and separating the electrophotographic image receiving sheet on which the toner image is formed, by using an image surface smoothing and fixing device having a heating and pressurizing member, a belt member and a cooling unit.

<12> The image forming method according to <11>, wherein the belt member contains a layer containing fluorocarbon siloxane rubber formed on a surface thereof.

<13> The image forming method according to <11>, wherein the belt member contains a layer containing silicone rubber formed on a surface thereof, and a layer containing fluorocarbon siloxane rubber formed on the layer containing silicone rubber.

<14> The image forming method according to any one of <12> and <13>, wherein the fluorocarbon siloxane rubber has at least any one of a perfluoro alkylether group and a perfluoro alkyl group in a main chain thereof.

An electrophotographic image receiving sheet of the present invention includes a support, and two toner image receiving layers formed over at least one surface of the support, wherein a mixture mass ratio M of a crystalline polymer and an amorphous polymer in each of the toner image receiving layers is defined as [A/(A+B)], where A represents a mass of the crystalline polymer (g), and B represents a mass of the amorphous polymer (g), and a mixture mass ratio M1 of the outermost toner image receiving layer which is located farthest from the support, and a mixture mass ratio M2 of the highest inner toner image receiving layer, which has the highest mixture mass ratio among the inner toner image receiving layers located under the outermost toner image receiving layer, satisfy the relation: M1<M2. The electrophotographic image receiving sheet of the present invention has a multilayer structure having at least two toner image receiving layers, each of which includes the crystalline polymer and the amorphous polymer, and the mixture mass ratios thereof are adjusted to an optimum distribution of the mixture mass ratios, which satisfies the relation: "M1<M2", so as to satisfy both excellent low temperature fixing property and excellent adhesion resistance, thereby forming a highly glossy and high-quality image.

The electrophotographic image receiving sheet of the present invention can be produced by coating of an aqueous coating solution, so that the electrophotographic image receiving sheet can be produced with less impact on the environment and at low cost.

Since the electrophotographic image receiving sheet of the present invention has excellent low temperature fixing property, a highly glossy and high-quality image can be formed, with a decrease in unpleasant uneven gloss occurring on a boundary line between an image portion and a non-image portion, even when the image is fixed by using a fixing device small in energy consumption.

Since the electrophotographic image receiving sheet of the present invention is also excellent in adhesion resistance, the toner image receiving layer of one electrophotographic image receiving sheet does not adhere to a back surface of another electrophotographic image receiving sheet, even when the toner image receiving layer of one electrophotographic image receiving sheet faces and superposes the back surface of another electrophotographic image receiving sheet during storage. Therefore, the electrophotographic image receiving sheet of the present invention can prevent occurrence of running failure such as jam, double feed in an image forming apparatus.

Further, since the electrophotographic image receiving sheet of the present invention has improved separation property from a fixing device, the toner image receiving layer does not adhere to a fixing member, thereby allowing to exhibit excellent passing performance in a fixing device, and causing no running failure such as jam and double feed in an image forming apparatus. Therefore, the electrophotographic image receiving sheet of the present invention achieves stable and smooth paper feeding.

An image forming method of the present invention includes forming a toner image on the electrophotographic image receiving sheet of the present invention, and smoothing and fixing a surface of the toner image formed on the electrophotographic image receiving sheet. By the use of the electrophotographic image receiving sheet of the present invention, the image forming method of the present invention exhibits excellent passing performance in a fixing device, and can efficiently form a highly-smooth, highly-glossy, uniform and high-quality image similar to that of a silver halide photographic print.

BEST MODE FOR CARRYING OUT THE INVENTION

Electrophotographic Image Receiving Sheet

Figure 1:
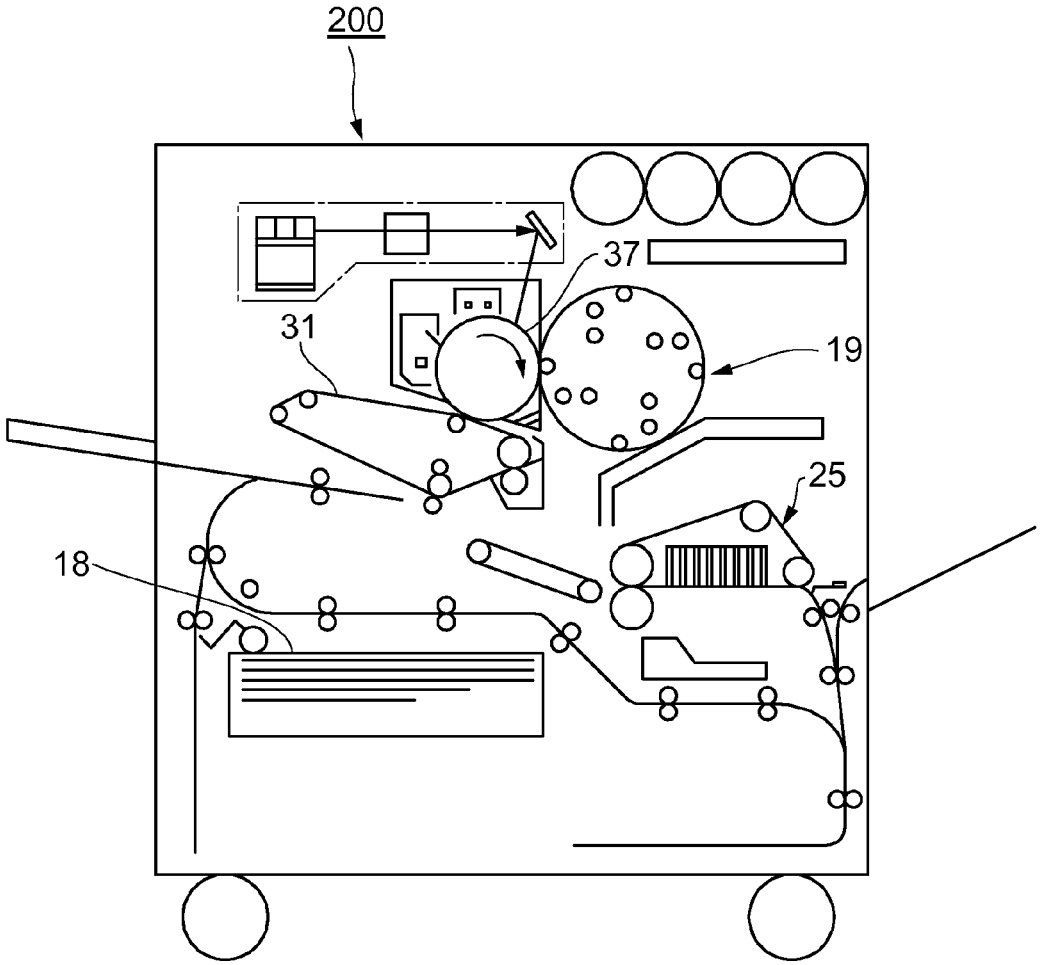
FIG. 1 is a schematic diagram showing one example of an image forming apparatus used in the present invention.

An electrophotographic image receiving sheet of the present invention includes a support, and at least two toner image receiving layers formed over at least one surface of the support, and may include an intermediate layer, and further include other layers as necessary.

<Toner Image Receiving Layer>

The toner image receiving layer is present in the electrophotographic image receiving sheet as a multilayer structure of at least two layers, and includes at least any one of a crystalline polymer and an amorphous polymer, and further includes other components, as necessary.

A mixture mass ratio M of the crystalline polymer and the amorphous polymer in each of the toner image receiving layers is defined as [A/(A+B)], where A represents a mass of the crystalline polymer (g), and B represents a mass of the amorphous polymer (g). A mixture mass ratio M1 of the outermost toner image receiving layer which is located farthest from the support, and a mixture mass ratio M2 of the highest inner toner image receiving layer, which has the highest mixture mass ratio among the inner toner image receiving layers located under the outermost toner image receiving layer, satisfy the relation: M1<M2. Namely, the mixture mass ratio of at least one of the inner toner image receiving layers is larger than that of the outermost toner image receiving layer.

In the case of M1≧M2, the passing performance in a fixing device may be adversely affected, or gloss may be poor. In the case where M1≧M2 and the mixture mass ratio M2 of the highest inner toner image receiving layer is small, the low temperature fixing property may not be sufficiently improved.

The mixture mass ratio M1 of the outermost toner image receiving layer is preferably 0.4 or less, and more preferably 0 to 0.3.

The mixture mass ratio M2 of the highest inner toner image receiving layer, which has the highest mixture mass ratio among the inner toner image receiving layers, is preferably 0.3 or more, and more preferably 0.4 or more. When M2 is less than 0.3, the low temperature fixing property may be poor.

Therefore, when the toner image receiving layer is present as a two layer structure which includes a second toner image receiving layer and a first toner image receiving layer in this order over the support, the mixture mass ratio M1 of the first toner image receiving layer and the mixture mass ratio M2 of the second toner image receiving layer preferably satisfy the relation: M1<M2.

Moreover, when the toner image receiving layer is present as a three layer structure which includes a third toner image receiving layer, the second toner image receiving layer, and the first toner image receiving layer in this order over the support, the mixture mass ratio M1 of the first toner image receiving layer, the mixture mass ratio M2 of the second toner image receiving layer, and a mixture mass ratio M3 of the third toner image receiving layer preferably satisfy the relation: M1<M2 or M1<M3, where M1 is smaller than any one of M2 and M3, whichever larger. In the case of M2<M3, the mixture mass ratios satisfy the relation: M1<M3, where M2 may be larger or smaller than M1.

The number of the at least two toner image receiving layers is preferably 2 to 4, and more preferably 2 to 3. When the electrophotographic image receiving sheet include less than 2 toner image receiving layers, there is no distribution in the mixture mass ratio.

The total thickness of the at least two toner image receiving layers is preferably 3 μm to 50 μm, and more preferably 5 μm to 20 μm.

The toner image receiving layer is preferably formed of a coating solution for the toner image receiving layer, which contains at least any one of a crystalline polymer aqueous dispersion containing at least the crystalline polymer and an amorphous polymer aqueous dispersion containing at least the amorphous polymer.

The crystalline polymer aqueous dispersion contains at least a crystalline polymer, and may contain a basic compound and water, and further contain other components, as necessary.

The amorphous polymer aqueous dispersion contains at least an amorphous polymer, and may contain water, and further contain other components, as necessary.

Here, the amorphous polymer and the crystalline polymer mean polymers which are identified by the following method.

In a nitrogen atmosphere, a polymer is heated from room temperature to 320° C., and kept for 10 minutes. Then, the polymer is rapidly cooled approximately to room temperature and immediately heated again from room temperature to 320° C. at a temperature increasing speed at 5° C./min by use of a differential scanning calorimeter (DSC) to determine an endothermic curve on the basis of the crystallization and melting. In this endothermic curve, the polymer, in which an endothermic peak (crystallization peak) attributable to crystallization is observed, is referred to as a "crystalline polymer" and the polymer, in which the endothermic peak is not observed, is referred to as an "amorphous polymer."

—Crystalline Polymer—

The crystalline polymer is preferably water dispersible.

There are no particular restrictions on the crystalline polymer and any appropriate polymer may be selected according to the intended use. However, in view of productivity and the like, thermoplastic resins are preferable. Examples of the thermoplastic resins include crystalline polyester resins; polyolefin resins such as a polyethylene and a polypropylene; polyamide resins, polyether resins, polyester amide resins, polyetherester resins, polyvinyl alcohol resins and polyestermethacrylate resins, or copolymers mainly consisting of these resins. These resins may be used alone or in combination. Of these resins, crystalline polyester resins are more preferable in view of compatibility with toner.

—Crystalline Polyester Resin—

The crystalline polyester resin is prepared by subjecting an acid component and an alcohol component to condensation polymerization. It also contains other components, as necessary.

There are no particular restrictions on the acid component and any appropriate acid may be selected according to the intended use. Examples of the acid component include aliphatic dicarboxylic acids such as a dodecanedioic acid, sebacic acid, succinic acid, oxalic acid, malonic acid, maleic acid, fumaric acid, citraconic acid, itaconic acid, glutaconic acid, adipic acid, sebacic acid, azelaic acid, n-dodecyl succinic acid, n-dodecenyl succinic acid; aromatic dicarboxylic acids such as a phthalic acid, isophthalic acid, terephthalic acid; cycloaliphatic dicarboxylic acids such as cyclohexane dicarboxylic acid; 2,5-norbornene dicarboxylic acid, tetrahydro phthalic acid and anhydrous tetrahydro phthalic acid. These acids may be used alone or in combination. Of these acids, dodecanedioic acid, sebacic acid, succinic acid and terephthalic acid are preferable in view of an appropriate melting point, crystallization and melting heat and the like.

There are no particular restrictions on the alcohol component, and any appropriate alcohol may be selected according to the intended use. Examples of the alcohol component include ethylene glycol, propylene glycol, 1,4-butanediol, trimethylol propane, neopentyl glycol, glycerine, pentaerythritol, hydrogenated bisphenol A, sorbitol; and glycols obtained by adding one to several moles of ethylene oxide or propylene oxide to two phenol hydroxyl groups of bisphenols. These alcohol components may be used alone or in combination. Of the alcohol components, in view of an appropriate melting point, crystal fusion heat and the like, preferable are ethylene glycol, 1,4-butanediol and trimethylol propane.

Other components include, for example, an esterification catalyst and a depolymerizing agent.

There are no particular restrictions on the esterification catalyst, and any appropriate materials may be selected according to the intended use. Examples of the esterification catalyst include titanium compounds and tin (II) compounds.

Examples of the titanium compounds include titanium diisopropylate bistriethanolaminate [Ti $(C_6H_{14}O_3N)_2(C_3H_{70})_2$], titanium diisopropylate bisdiethanolaminate [Ti $(C_4H_{10}O_2N)_2(C_3H_7O)_2$], titanium dipentylate bistriethanolaminate [Ti $(C_6H_{14}O_3N)_2(C_5H_{11}O)_2$], titanium diethylate bistriethanolaminate [Ti $(C_6H_{14}O_3N)_2(C_2H_5O)_2$], titanium dihydroxyoctylate bistriethanolaminate [Ti $(C_6H_{14}O_3N)_2(OHC_8H_{16}O)_2$], titanium distearate bistriethanolaminate [Ti $(C_6H_{14}O_3N)_2(C_{18}H_{37}O)_2$], titanium triisopropylate triethanolaminate [Ti $(C_6H_{14}O_3N)_3(C_3H_7O)_3$], and titanium monopropylate tris (triethanolaminate) [Ti $(C_6H_{14}O_3N)_3(C_3H_7O)_1$].

Examples of the tin (II) compounds include tin carboxylates (II) having a carboxylic acid group having 2 to 28 carbon atoms such as a tin oxalate (II), tin diacetate (II), tin dioctanoate (II), tin dilaurate (II), tin distearate (II), tin diolenate (II); dialkoxy tins (II) having an alkoxy group having 2 to 28 carbon atoms such as a dioctyloxy tin (II), dilauroxy tin (II), distearoxy tin (II), and dioleyloxy tin (II); oxidized tins (II); and tin sulfates (II).

The amount of the esterification catalyst is preferably 0.01 parts by mass to 1.0 part by mass and more preferably 0.1 parts by mass to 0.7 parts by mass with respect to 100 parts by mass of the alcohol component and the acid component in total. When the amount of the esterification catalyst with respect to 100 parts by mass of the alcohol component and the acid component in total is less than 0.01 parts by mass, the number average molecular mass is not increased, causing cracks in the toner image receiving layer. On the other hand, when it exceeds 1.0 part by mass, the catalyst is present in the toner image receiving layer as a foreign substance, causing black spots on a white background, and quality of an image may be deteriorated.

There are no particular restrictions on the depolymerizing agent, and any appropriate agent may be selected according to the intended use. Examples of the depolymerizing agent include trivalent or higher polyvalent carboxylic acids such as a trimellitic acid and pyromellitic acid; and anhydrates of these acids. These depolymerizing agents are used to cause reactions (depolymerization and addition reaction), by which a carboxyl group can be introduced into the crystalline polyester resin.

The acid component and the alcohol component can be subjected to condensation polymerization, for example, in the presence of the esterification catalyst in an inert gas atmosphere at a temperature from 180° C. to 280° C.

A melting point of the crystalline polyester resin is preferably at 80° C. or higher, more preferably 80° C. to 110° C. and particularly preferably 80° C. to 100° C. When the melting point is less than 80° C., blocking may occur on the electrophotographic image receiving sheet. In contrast, when it exceeds 110° C., for example, the electrophotographic image receiving sheet may be lower in toner fixing property and decrease in gloss level.

Here, the melting point can be measured, for example, by using a differential scanning calorimeter (DSC).

An acid value of the crystalline polyester resin is preferably 15 mgKOH/g to 40 mgKOH/g and more preferably 15 mgKOH/g to 30 mgKOH/g. When the acid value is less than 15 mgKOH/g, a stable water dispersion may not be obtained. When it exceeds 40 mgKOH/g, a toner image receiving layer may be lower in strength or decrease in water resistance and moisture resistance.

Here, the acid value can be measured in accordance with a method described in JIS K0070, for example.

The number average molecular mass of the crystalline polyester resin is preferably 5,000 to 20,000 and more preferably 6,000 to 12,000. When the number average molecular mass is less than 5,000, the toner image receiving layer decreases in mechanical strength, and the toner image receiving layer may easily crack. When it exceeds 20,000, the toner image receiving layer may be lower in toner fixing property and decrease in gloss level.

Here, the number average molecular mass can be measured, for example, by gel permeation chromatography (GPC), using tetrahydrofuran as an eluate, on polystyrene conversion.

The crystalline polymer aqueous dispersion contains at least a crystalline polymer and further contains a basic compound, water and other components, if necessary. There are no particular restrictions on the crystalline polymer aqueous dispersion, and they can be prepared by a known method.

The amount of the crystalline polymer aqueous dispersion in the crystalline polymer is preferably 20% by mass to 40% by mass, and more preferably 30 by mass to 40% by mass on solid content basis. When the amount is less than 20% by mass, a coating solution may decrease in viscosity, and when it exceeds 40% by mass, the solution is more likely to increase in viscosity, forming coagulation.

The basic compound is added to disperse the crystalline polymer uniformly and stably in water. The basic compound includes, for example, ammonia with a low boiling point, an organic amine compound, and the like. The boiling point of the organic amine compound is preferably at 160° C. or less. Moreover, it is preferable that the organic amine compound be azeotropic with water. When the boiling point is higher than 160° C., the basic compound may remain in the toner image receiving layer, decreasing the physical properties of a film or giving off a bad smell, thus it is not desirable.

There are no particular restrictions on the basic compound, and any basic compound may be used according to the intended use. Examples of the basic compound include ammonia, methylamine, dimethylamine, trimethylamine, ethylamine, diethylamine, triethylamine, propylamine, dipropylamine, isopropylamine, diisopropylamine, butylamine, dibutylamine, isobutylamine, diisobutylamine, sec-butylamine, tert-butylamine, pentylamine, N,N-dimethylethanolamine, N-methyl-N-ethanolamine, propylenediamine, morpholine, N-methylmorphorine, N-ethylmorpholine, and piperidine. The basic compounds may be used alone or in combination.

The amount of the crystalline polymer aqueous dispersion in the basic compound is preferably 0.9 to 15-times equivalence with respect to the carboxyl group in such a content that can at least partially neutralize depending on a carboxyl group content in the crystalline polyester resin. When the quantity is less than 0.9-times equivalence, the dispersion may be difficult or aqueous dispersion may decrease in stability. When it exceeds 15-times equivalence, the aqueous dispersion may greatly increase in viscosity.

—Amorphous Polymer—

The amorphous polymer is preferably water dispersible.

There are no particular restrictions on the amorphous polymer, and any appropriate amorphous polymer may be selected according to the intended use. However, in view of productivity, thermoplastic resins are preferable. Examples of the thermoplastic resins include amorphous polyester resins, polyvinyl chloride resins, polystyrene resins, acrylonitrile-styrene copolymers, acrylonitrile-butadiene-styrene copolymers, polymethyl methacrylate acrylate resins, polycarbonate resins, modified polyphenylene ether resins, polyarylate resins, polysulfone resins, polyetherimide resins, polyamideimide resins, polyimide resins, and copolymers mainly consisting of the above-described materials. The thermoplastic resins may be used alone or in combination. Of these resins, amorphous polyester resins are more preferable in view of compatibility with the toner.

There are no particular restrictions on the amorphous polyester resin, and any known amorphous polyester resins may be selected appropriately according to the intended use. A commercially available product or an appropriately synthesized product may be used. Of the amorphous polyester resins, commercially available ones include, for example, BIRON series (BIRON 200, BIRON 296 and the like) manufactured by Toyobo Co., Ltd, and the like.

The glass transition temperature of the amorphous polyester resin is preferably 30° C. to 120° C. When the glass transition temperature is less than 30° C., the amorphous polyester resin decreases in adhesion resistance, easily causing blocking. When it exceeds 120° C., the electrophotographic image receiving sheet may decrease in toner fixing property, decreasing gloss level.

Of the crystalline and amorphous polyester resins, self-dispersible polyester resins are preferable. Of the self-dispersible polyester resins, a carboxyl group-containing self-dispersible polyester resin is particularly preferable. Here, "the self-dispersible polyester resin" means a polyester resin capable of self-dispersing in an aqueous solvent without using an emulsifying agent. Further, the "carboxyl group-containing self-dispersible polyester resin" means a polyester resin which contains a carboxyl group as a hydrophilic group and can self-disperse in an aqueous solvent.

The self-dispersible polyester resin has (1) a number average molecular mass (Mn) preferably from 5,000 to 10,000, more preferably from 5,000 to 7,000, (2) a molecular weight distribution (mass average molecular weight/number average molecular weight) preferably of 4 or less, and more preferably of 3 or less, (3) a glass transition temperature (Tg) preferably from 40° C. to 100° C. and more preferably from 50° C. to 80° C., and (4) a volume average particle diameter preferably from 20 nm to 200 nm and more preferably from 40 nm to 150 nm.

Since such self-dispersible polyester resins which satisfy the above characteristics are self-dispersible resins without using a surfactant, they are low in hygroscopicity even in a highly humid environment and less likely to have a decreased softening point due to water content, thereby preventing the occurrence of offset on fixation and the occurrence of adhesion failure between sheets during storage. Further, since the self-dispersible polyester resins are water dispersible, a coating solution for the toner image receiving layer containing the self-dispersible polyester resin can be an aqueous coating solution, thereby making it possible to decrease an environmental impact on production of materials for the toner image receiving layer. They are also polyester resins which tend to assume a molecular structure having high coagulation energy. Therefore, the toner image receiving layer containing the self-dispersible polyester resin is in a molten state with low elasticity (low viscosity) in a fixing step of an image, with a sufficient hardness kept during storage, thereby making it possible to form a high-quality image excellent in fixing property.

The coating solution for the toner image receiving layer may contains a releasing agent, a plasticizer, a colorant, and a filler, in addition to the above-described resins, and further contains other components such as a cross-linking agent, a charge controlling agent, an emulsifying agent, a dispersing agent and the like, as necessary.

—Releasing Agent—

The releasing agent is formulated into the toner image receiving layer for preventing the offset of the toner image receiving layer. There are no particular restrictions on the releasing agent, and any appropriate releasing agent may be selected according to the intended use, as long as it is heated at a fixing temperature, melted to be unevenly distributed after deposition on the surface of the toner image receiving layer and solidified by cooling, thereby forming a releasing agent layer on the surface of the toner image receiving layer.

The releasing agents include, for example, silicone compounds, fluorine compounds, wax and matting agents.

The details thereof are described in paragraphs [0071] to [0087] in JP-A No. 2005-292762.

The amount of the releasing agent is preferably 0.1% by mass to 10% by mass based on the mass of the toner image receiving layer, more preferably 0.3% by mass to 8.0% by mass, and even more preferably 0.5% by mass to 5.0% by mass.

—Plasticizer—

There are no particular restrictions on the plasticizers, and any plasticizer for resins may be appropriately selected from known ones according to the intended use. The plasticizers have functions to adjust the fluidization or softening of the toner image receiving layer by using heat or pressure on fixation of the toner to the toner image receiving layer.

The details of the plasticizers are described in paragraphs [0089] to [0092] in JP-A No. 2005-292762.

The amount of the plasticizer in the toner image receiving layer is preferably 0.001% by mass to 90% by mass, more preferably 0.1% by mass to 60% by mass, and even more preferably 1% by mass to 40% by mass.

—Colorant—

There are no particular restrictions on colorants, and any colorant may be appropriately selected according to the intended use. Examples of the colorants include fluorescent whitening agents, white pigments, colored pigments and dyes.

The details thereof are described in paragraphs [0093] to [0096] in JP-A No. 2005-292762.

The amount of the colorant in the toner image receiving layer is preferably 0.1 $g/m^2$ to 8 $g/m^2$ and more preferably 0.5 $g/m^2$ to 5 $g/m^2$.

—Filler—

The fillers can be classified into organic fillers and inorganic fillers.

The details thereof are described in paragraphs [0098] to [0100] in JP-A No. 2005-292762.

The amount of the filler added is preferably 5 parts by mass to 2,000 parts by mass with respect to 100 parts by mass on a dry mass basis of a binder of the toner image receiving layer.

As other components such as the cross-linking agent, the cross-linking agent, the charge controlling agent, the emulsifying agent, the dispersing agent, those described in paragraphs [0102] to [0110] in JP-A No. 2005-292762 may be properly selected for use.

The toner image receiving layer is formed by applying the coating solution for the toner image receiving layer on the support by a wire coater or the like, and then drying.

The dried coated amount of the toner image receiving layer is, for example, preferably 1 $g/m^2$ to 20 $g/m^2$ and more preferably 4 $g/m^2$ to 15 $g/m^2$.

As to the 180 degree peel strength test of the toner image receiving layer at a fixing temperature by a fixing member, and the gloss, smoothness and surface electric resistance of the toner image receiving layer, those satisfying the physical properties described in paragraphs [0113] to [0117] in JP-A No. 2005-292762 are preferably used.

<Support>

The support includes raw paper, and at least one polyolefin resin layer formed on both surfaces of the raw paper, and further includes other layers, as necessary.

—Raw Paper—

There are no particular restrictions on the raw paper, and any appropriate raw paper may be selected according to the intended use. However, preferable is fine paper. The fine paper includes, for example, that described in "Basis of Photographic Engineering, Silver Halide Photography" pp. 223-224, published by Corona Publishing Co., Ltd., (1979), edited by the Society of Photographic Science and Technology of Japan.

It is preferable that pulp fiber having a fiber length distribution (for example, a total of 24 mesh screen residue and 42 mesh screen residue is 20% by mass to 45% by mass and 24 mesh screen residue is 5% by mass or less) be used for the raw paper to impart a desired centerline average roughness to a surface thereof, for example, as described in JP-A No. 58-68037. The surface of the raw paper is treated by applying heat and pressure using a machine calendar, a super calendar or the like, so as to adjust the centerline average roughness.

There are no particular restrictions on raw materials of the raw paper, as long as they are any known materials used as the support, and any appropriate materials may be selected according to the intended use. Examples of the raw materials include natural pulp of broad-leaf trees and needle-leaf trees, and mixtures of natural pulp and synthetic pulp.

Pulp, which can be used as a raw material of the raw paper, is preferably a broad-leaf bleached kraft pulp (LBKP) in view of the fact that the surface smoothness, rigidity and dimensional stability (curl resistance) of the raw paper can be improved simultaneously in a well-balanced manner to a satisfactory level. However, needle-leaf bleached kraft pulp (NBKP), and leaf bleached sulfite pulp (LBSP) may be used as well.

The pulp can be beaten by using a beater, a refiner and the like.

The Canadian standard freeness of pulp is preferably 200 mL C.S.F. to 440 mL C.S.F. and more preferably 250 mL C.S.F. to 380 mL C.S.F. since paper can be controlled for shrinkage in paper making steps.

Pulp slurry, which is obtained after the pulp is beaten, (hereinafter, referred to as pulp paper stock) may contain, if necessary, various additives such as a filler, dry paper strength additive, sizing agent, wet paper strength additive, fixing agent, pH adjuster, pitch control agent, slime control agent and other agents.

The filler includes, for example, calcium carbonate, clay, kaoline, white clay, talc, titanium oxide, diatomaceous earth, barium sulfate, aluminum hydroxide, magnesium hydroxide, calcinated clay, calcinated kaoline, delamikaoline, heavy calcium carbonate, light calcium carbonate, magnesium carbonate, barium carbonate, zinc oxide, silicon oxide, amorphous silica, aluminum hydroxide, calcium hydroxide, zinc hydroxide, urea-formalin resin, polystyrene resin, phenol resin, micro hollow grains and the like.

The dry paper strength additive includes, for example, cationic starch, cationic polyacryl amide, anionic polyacryl amide, amphoteric polyacrylamide, carboxy modified polyvinyl alcohol and the like.

The sizing agent includes, for example, higher fatty acid salts; styrene-acrylic compounds, petroleum resin-based sizing agents; rosin, rosin derivatives such as a maleic rosin, paraffin wax, alkyl ketene dimmer, alkenyl succinic anhydride (ASA), compounds containing higher fatty acids such as epoxidized fatty acid amides, and the like.

The wet paper strength additive includes, for example, polyamine polyamide epichlorohydrin, melamine resins, urea resins, epoxidized polyamide resins, and the like.

The fixing agent includes, for example, polyvalent metal salts such as aluminum sulfate and aluminum chloride; basic aluminum compounds such as a sodium aluminate, basic aluminum chloride and basic polyaluminium hydroxide; polyvalent metal compounds such as ferrous sulfate and ferric sulfate; water-soluble polymers such as starch, modified starch, polyacrylamide, urea resin, melamine resin, epoxy resin, polyamide resin, polyamine resin, polyethylene imine, vegetable gum, and polyethylene oxide; cationic polymers such as cationic starch; hydrophilic cross-linked polymer particle dispersion, various compounds such as their derivatives or modified products, and the like.

The pH adjuster includes, for example, caustic soda, sodium carbonate, and the like.

Other agents include, for example, antifoaming agents, dyes, slime control agents, fluorescent whitening agents, and the like.

A softening agent may be added as necessary. Examples of the softening agent include those described in "Paper and Paper Treatment Manual" (edited by Shiyaku Time Co., Ltd. (1980) (pp. 554-555)).

These various additives may be used alone or in combination. There are no particular restrictions on the amount of these additives in the pulp paper stock, and any amount may be selected according to the intended use. However, it is preferably 0.1% by mass to 1.0% by mass.

The raw paper is prepared by making the pulp paper stock containing various additives into paper by using a paper making machine such as a handmade paper making machine, Fourdrinier machine, cylinder paper making machine, twin wire machine or combination machine, and then drying. Further, if so desired, sizing can be performed to the surface either after or before drying.

There are no particular restrictions on a treatment solution used in the surface sizing, and any treatment solution may be appropriately selected according to the intended use. The solution includes, for example, water-soluble high molecular compounds, water resistant materials, pigments, dyes, fluorescent whitening agents, and the like.

The water-soluble high molecular compounds include, for example, cationic starch, oxidized starch, polyvinyl alcohol, carboxy modified polyvinyl alcohol, carboxymethyl cellulose, hydroxyethyl cellulose, cellulose sulfate, gelatin, casein, sodium polyacrylate, sodium salt of styrene-maleic anhydride copolymer, sodium polystyrene sulfonate, and the like.

The water resistant materials include, for example, styrene-butadiene copolymer, ethylene-vinyl acetate copolymer, polyethylene, latex/emulsions such as a vinylidene chloride copolymer, polyamidepolyamine epichlorohydrin, synthetic wax, and the like.

The pigments include, for example, calcium carbonate, clay, kaoline, talc, barium sulfate, titanium oxide, and the like.

It is preferable in view of improvement in rigidity and dimensional stability (curl resistance) that the raw paper have a ratio (Ea/Eb) of vertical Young's modulus (Ea) to lateral Young's modulus (Eb) in the range of 1.5 to 2.0. When the ratio of Ea/Eb is less than 1.5 or more than 2.0, the electrophotographic image receiving sheet easily degrades in rigidity and curl resistance, adversely affecting traveling performance during transportation. Thus it is not desirable.

In general, it is known that "stiffness" of paper varies depending on the difference in the beating manner. An elastic force (elastic modulus), which is imparted to paper made after beating, can be used as an important factor for expressing the degree of stiffness. In particular, by taking advantage of the relation between density and dynamic elastic modulus exhibiting physical properties of viscoelastic materials contained in paper, the sound speed traveling through paper is measured by an ultrasonic transducer, so that the elastic modulus of paper can be determined by the following formula.

$$E=\rho c^2(1-n^2)$$

where E represents a dynamic elastic modulus; ρ represents a density; "c" represents a sound speed traveling through paper; and "n" represents a Poisson ratio.

Further, in the case of plain paper, since "n" is approximately 0.2, the following formula may be used to calculate the elastic modulus of paper, without any significant difference.

$$E=\rho c^2$$

In other words, as long as the density and sound speed of paper can be measured, the elastic modulus can be obtained easily. Sonic Tester, Model SST-110 (manufactured by Nomura Shoji Co., Ltd.,) or other known instruments may be used to measure the sound speed by the above formula.

There are no particular restrictions on thickness of the raw paper, and any thickness may be appropriately selected according to the intended use. The thickness is preferably 30 μm to 500 μm, more preferably 50 μm to 300 μm, and even more preferably 100 μm to 250 μm. Further, there are no particular restrictions on basis weight of the raw paper, and any basis weight may be appropriately selected according to the intended use. For example, the basis weight is preferably 50 g/m$^2$ to 250 g/m$^2$ and more preferably 100 g/m$^2$ to 200 g/m$^2$.

The raw paper is preferably subjected to calendar treatment. The calendar treatment is preferably performed in such a manner that a metal roll is brought into contact with a surface of the raw paper on which surface the toner image receiving layer is provided.

The surface temperature of the metal roll is preferably 100° C. or more, more preferably 150° C. or more, and even more preferably 200° C. or more. There are no particular restrictions on an upper limit of the surface temperature of the metal roll, and any upper limit of the surface temperature may be appropriately selected according to the intended use. For example, about 300° C. is preferable.

There are no particular restrictions on a nip pressure on the calendar treatment, and any nip pressure may be appropriately selected according to the intended use. The nip pressure is preferably 100 kN/cm$^2$ or more, and more preferably 100 kN/cm$^2$ to 600 kN/cm$^2$.

There are no particular restrictions on a calendar used in the calendar treatment, and any appropriate calendar may be used according to the intended use. The calendar includes, for example, a calendar having a soft calendar roll combined with a metal roll and a synthetic resin roll, a calendar having a machine calendar roll made up of a pair of metal rolls, and the like. Of these, preferable is the calendar having a soft calendar roll, and more preferable is a long nip shoe calendar made up of a metal roll and a shoe roll via a synthetic resin belt in view of the availability of a long nip-width.

—Polyolefin Resin Layer—

At least one of the polyolefin resin layer is formed on both surfaces of the raw paper, and at least two front surface polyolefin resin layers are formed over the surface of the raw paper, over which surface the toner image receiving layer is formed. The polyolefin resin layers consist of the outermost front surface polyolefin resin layer located furthest from the raw paper and a front surface polyolefin resin layer other than the outermost front surface polyolefin resin layer.

When the front surface polyolefin resin layers consist of two layers includes a lower polyolefin resin layer and an upper polyolefin resin layer in this order over the raw paper, the upper polyolefin resin layer is given as the outermost front surface polyolefin resin layer and the lower polyolefin resin layer is given as the front surface polyolefin resin layer other than the outermost front surface polyolefin resin layer.

Further, when the front surface polyolefin resin layers consist of three layers of a lower polyolefin resin layer, a middle polyolefin resin layer and an upper polyolefin resin layer in this order over the raw paper, the upper polyolefin resin layer is given as the outermost front surface polyolefin resin layer, and the lower polyolefin resin layer and the middle polyolefin resin layer are given as the front surface polyolefin resin layers other than the outermost front surface polyolefin resin layer.

The density of the outermost front surface polyolefin resin layer is smaller than the density of at least any of the layers among front surface polyolefin resin layers other than the outermost front surface polyolefin resin layer. As a result, no blisters are caused by heating on image formation, development or fixation, thereby recording a high-quality image free from uneven recording or uneven fixation.

The density of the outermost front surface polyolefin resin layer is preferably 0.930 g/cm$^3$ or less and more preferably 0.925 g/cm$^3$ or less.

Further, the density of at least any of the front surface polyolefin resin layers other than the outermost front surface polyolefin resin layer (or an average value thereof in the case where the front surface polyolefin resin layers consist of a plurality of layers) is preferably 0.930 g/cm$^3$ or more, and more preferably 0.950 g/cm$^3$ or more, and the upper limit of the density value is 0.970 g/cm$^3$.

The thickness of at least any of the front surface polyolefin resin layers other than the outermost front surface polyolefin resin layer is preferably 15 μm or more, and more preferably 15 μm to 20 μm. When the thickness is less than 15 μm, a limit temperature for withstanding blisters is lowered and blisters may occur at a lower temperature.

Further, the thickness of the outermost front surface polyolefin resin layer is preferably 5 μm or more, and more preferably 10 μm to 30 μm. When the thickness of the outermost front surface polyolefin resin layer is less than 5 μm, an uneven recording or uneven fixation resulting from a tracking failure may occur, and when it exceeds 30 μm, productivity may be decreased due to restrictions on a melting discharge amount of the polyolefin resin.

There are no particular restrictions on the thickness of the back surface polyolefin resin layer, and any appropriate thickness may be selected according to the intended use. However, it is preferable to appropriately adjust the back surface so that curls are flattened in a final configuration, in view of the curl balance.

Polyolefin resins used in the polyolefin resin layer include, for example, polyethylene, polypropylene, a mixture of polypropylene with polyethylene, high-density polyethylene, a mixture of high-density polyethylene with low-density polyethylene and the like.

It is preferable that the outermost front surface polyolefin resin layer contains a low-density polyethylene having a density of 0.930 g/cm$^3$ or less (preferably 0.925 g/cm$^3$ or less) and also at least any of the front surface polyolefin resin layers other than the outermost front surface polyolefin resin layer contains a high-density polyethylene having a density of 0.945 g/cm$^3$ or more (preferably 0.950 g/cm$^3$ or more).

The amount of the high-density polyethylene having a density of 0.945 g/cm$^3$ or more in at least any of the front surface polyolefin resin layers other than the outermost front surface polyolefin resin layer is preferably 30% by mass or more, and more preferably 50% by mass or more.

It is preferable that at least either the front surface or the back surface of the polyolefin resin layer contains either an organic pigment or an inorganic pigment.

Examples of the organic pigment include ultramarine blue, cerulean blue, phthalocyanine blue, cobalt violet, fast violet and manganese violet.

Examples of the organic pigment include titanium dioxide, calcium carbonate, talc, stearic acid amide and zinc stearate.

Of these, preferable is titanium dioxide. Either anatase-type titanium dioxide or rutile-type titanium dioxide may be used as the titanium dioxide. The amount of the titanium dioxide in the polyolefin resin layer is preferably 5% by mass to 30% by mass.

There are no particular restrictions on the method for forming the polyolefin resin layer, and any appropriate method may be selected according to the intended use. Examples of the method include a normal lamination method, a sequential lamination method, a lamination method in which a single-layered extrusion die or a multi-layered extrusion die such as feet-block type, multi-manifold type and multi-slot type and a laminator are used, and a co-extrusion coating method in which extrusion coating is performed in a multi-layered manner at the same time. There are no particular restrictions on the configuration of a die used in the single-layered extrusion or the multi-layered extrusion, and any appropriate configuration may be selected according to the intended use. For example, preferable are a T die, a coat hanger die, and the like.

There are no particular restrictions on the thickness of the support, and any appropriate thickness may be selected according to the intended use. The thickness is preferably 25 μm to 300 μm, more preferably 50 μm to 260 μm, and even more preferably 75 μm to 220 μm.

<Intermediate Layer>

In the present invention, an intermediate layer which contains a polymer for the intermediate layer, may be formed on a surface of the support. When the electrophotographic image receiving sheet includes the support, the toner image receiving layer and the intermediate layer, the intermediate layer may be formed between the support and the toner image receiving layer.

The intermediate layer is formed, for example, by preparing a coating solution for the intermediate layer, and then applying the coating solution. By the use of the coating solution for the intermediate layer, the intermediate layer can be relatively easily formed on the support. Further, by the use of the coating solution for the intermediate layer, the polymer for the intermediate layer can be permeated in the thickness direction of the support.

It is preferable that the polymer for the intermediate layer have a glass transition temperature equal to or lower than the fixing temperature of an image and be appropriately used as the coating solution for the intermediate layer. There are no particular restrictions on the polymer for the intermediate layer, as long as the coating solution for the intermediate layer can be prepared, and any polymer may be appropriately selected according to the intended use. For example, resins similar to the polymers for the toner image receiving layer may be used. Of these, the water soluble polymers, the water dispersible polymers are preferably used, and in particular the self-dispersible water-based polyester resin emulsions or water dispersible acryl resins are preferably used.

The polymer for the intermediate layer may be used in combination with other polymer materials. In this case, generally, the amount of the polymer for the intermediate layer is larger than that of other polymer materials.

The amount of the polymer for the intermediate layer in the intermediate layer is preferably 20% by mass or more, and more preferably 30% by mass to 100% by mass based on a mass of the intermediate layer.

The polymer for the intermediate layer includes those which satisfy the physical properties described in JP-A No. 05-127413, JP-A No. 08-194394, JP-A No. 08-334915, JP-A No. 08-334916, JP-A No. 09-171265, and JP-A No. 10-221877.

It is noted that the various components such as those referred to with regard to the toner image receiving layer may be optionally formulated into the intermediate layer as long as they do not adversely affect functions of the intermediate layer.

There are no particular restrictions on the thickness of the intermediate layer, and any thickness may be appropriately selected according to the intended use. The thickness is preferably 4 μm to 50 μm, for example.

[Other Layers]

Other layers in the electrophotographic image receiving sheet include, for example, a back layer, a surface-protective layer, an adhesiveness improving layer, a cushion layer, an electrostatic-charge preventive layer, a reflection layer, a color adjusting layer, a storage improving layer, an adhesion preventive layer, an anti-curl layer, a smoothing layer and the like. These layers may be structured in a single layer or two or more layers.

The details of other layers are described in paragraphs [0121] to [0125] in JP-A No. 2005-292762.

There are no particular restrictions on the thickness of the electrophotographic image receiving sheet, and any thickness may be appropriately selected according to the intended use. For example, it is preferably 50 μm to 550 μm, and more preferably 100 μm to 350 μm.

<Toner>

The electrophotographic image receiving sheet of the present invention is used in such a manner that toner is applied on the toner image receiving layer on printing or copy.

The toner contains at least a binding resin and a colorant, and further contains a releasing agent and other components, as necessary.

The details thereof are described in paragraphs [0130] to [0142] in JP-A No. 2005-292762.

(Image Forming Method)

The image forming method of the present invention includes a toner image forming step and an image surface smoothing and fixing step, and further includes other steps, as necessary.

—Toner Image Forming Step—

The toner image forming step is a step of forming a toner image on the electrophotographic image receiving sheet of the present invention.

There are no particular restrictions on the toner image forming step, as long as it is able to form a toner image on the electrophotographic image receiving sheet, and any step may be appropriately selected according to the intended use. The step includes a step used in ordinary electrophotography, for example, a direct transfer system for transferring a toner image formed on a development roller to the electrophotographic image receiving sheet, and an intermediate transfer belt system, in which a toner image is primarily transferred to an intermediate transfer belt or the like, and then transferred onto the electrophotographic image receiving sheet. Of these, the intermediate transfer belt system is preferably used in view of environmental stability and attaining a high image quality.

—Image Surface Smoothing and Fixing Step—

The image surface smoothing and fixing step is a step, that is smoothing and fixing a surface of the toner image formed in the toner image forming step. More specifically, in the image surface smoothing and fixing step, the electrophotographic image receiving sheet on which the toner image is formed is heated and pressurized, and cooled and separated by using an image surface smoothing and fixing device having a heating and pressurizing member, a belt member and a cooling unit.

The image surface smoothing and fixing device includes a heating and pressurizing member, a belt member, and a cooling unit, and further includes a cooling and separating portion and other members, as necessary.

There are no particular restrictions on the heating and pressurizing member, and any member may be appropriately selected according to the intended use. The member includes, for example, a pair of heating rollers and a combination of a heating roller and a pressure roller.

There are no particular restrictions on the cooling unit, and any unit may be appropriately used according to the intended use. The cooling unit includes, for example, a heat sink, or a cooling unit capable of feeding cold air to adjust the cooling temperature, or the like.

There are no particular restrictions on the cooling an separating portion, and any portion may be appropriately selected according to the intended use. The cooling and separating portion includes, for example, a tension-roll vicinity position, where the electrophotographic image receiving sheet is separated from the belt due to the rigidity (stiffness) thereof in itself.

It is preferable to apply a pressure when the toner image is brought into contact with the heating and pressurizing member of the image surface smoothing and fixing device. There are no particular restrictions on the method for applying a pressure, and any method may be appropriately selected according to the intended use, however, a method using a nip pressure is preferable. The level of the nip pressure is preferably 1 kgf/cm$^2$ to 100 kgf/cm$^2$ and more preferably 5 kgf/cm$^2$ to 30 kgf/cm$^2$ in view of forming an image excellent in water resistance and surface smoothness and favorable in gloss. Further, the heating and pressurizing member may be heated at any temperature equal to or higher than a softening point of the polymer for the toner image receiving layer. The temperature is generally preferably 80° C. to 200° C., although it varies depending on the polymers used for the toner image receiving layer. The cooling temperature of the cooling unit is preferably 80° C. or less at which the toner image receiving layer is sufficiently solidified and more preferably 20° C. to 80° C.

The belt member includes a support film and a release layer formed on the support film.

There are no particular restrictions on materials of the support film as long as they are heat resistant, and any material may be appropriately selected according to the intended use. Examples of the materials include polyimide (PI), polyethylene naphthalate (PEN), polyethylene terephthalate (PET), polyether ether ketone (PEEK), polyether sulphon (PES), polyetherimide (PEI), and polyparabanic acid (PPA).

It is preferable that the release layer contain at least one selected from a silicone rubber, a fluorine rubber, a fluorocarbon siloxane rubber, a silicone resin and a fluorine resin. Of these, preferable are an aspect in which a layer containing fluorocarbon siloxane rubber is provided on the surface of a belt member, and an aspect in which a silicone-rubber containing layer is provided on the surface of the belt member and the layer containing fluorocarbon siloxane rubber is provided on the surface of the silicone-rubber containing layer.

The fluorocarbon siloxane rubber preferably has at least either a perfluoro alkylether group or a perfluoro alkyl group on the main chain.

The fluorocarbon siloxane rubber is preferably a cured product of a fluorocarbon siloxane rubber composition containing the following components (A) to (D):

(A) Fluorocarbon polymer mainly containing fluorocarbon siloxane expressed by the following General Formula (1) and having an aliphatic unsaturated group;

(B) At least either organopolysiloxane or fluorocarbon siloxane which has at least two ═SiH groups in one molecule and the amount of the ═SiH group is 1 to 4 time-molar amount with respect to the amount of aliphatic unsaturated group in the fluorocarbon siloxane rubber composition;

(C) Filler; and (D) Catalyst in an effective amount.

The fluorocarbon polymer of the (A) component mainly includes fluorocarbon siloxane having the repeating unit expressed by the following formula (1) and has an aliphatic unsaturated group.

General Formula (1)

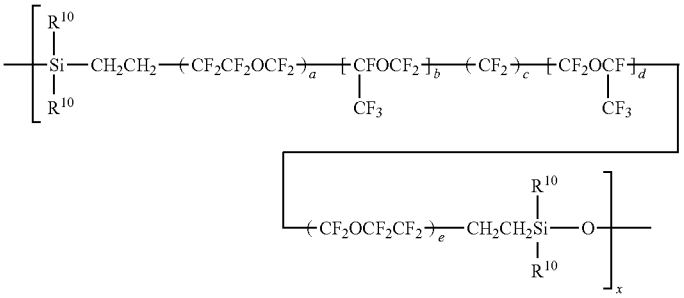

In the General Formula (1), $R^{10}$ represents an unsubstituted or substituted monovalent hydrocarbon group having 1 to 8 carbon atoms; an alkyl group having 1 to 8 carbon atoms, or an alkenyl group having 2 to 3 carbon atoms is preferable, and a methyl group is particularly preferable.

Further, "a" and "e" each represent an integer of 0 or 1. "b" and "d" each represent an integer of 1 to 4, and "c" represents an integer of 0 to 8. "x" preferably represents an integer of 1 or more, and more preferably an integer of 10 to 30.

The (A) component includes those expressed by the following General Formula (2).

General Formula (2)

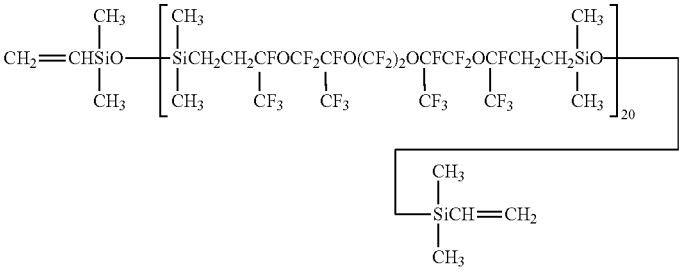

In the (B) component, the organopolysiloxane having ═SiH group includes organohydrogenpolysiloxane having in a molecule at least two hydrogen atoms bonded to a silicon atom.

Further, in the fluorocarbon siloxane rubber composition, in the case where the fluorocarbon polymer of the (A) component has an aliphatic unsaturated group, the above-described organohydrogenpolysiloxane is preferably used as a curing agent. Namely, a cured product is formed by addition reaction of an aliphatic unsaturated group in the fluorocarbon siloxane with hydrogen atoms bonded to a silicon atom in the organohydrogenpolysiloxane.

As the organohydrogenpolysiloxane, various organohydrogenpolysiloxanes used in an addition-curing silicone rubber composition may be used.

The organohydrogenpolysiloxane is preferably formulated in such a manner that the number of ═SiH groups thereof is preferably at least one, and more preferably 1 to 5 with respect to one aliphatic unsaturated hydrocarbon group in fluorocarbon siloxane of the (A) component.

A fluorocarbon having the ═SiH group is preferably those in which, in units expressed by General Formula (1) or in General Formula (1), $R^{10}$ is a dialkylhydrogensiloxy group and having the dialkylhydrogensiloxy group, the ═SiH group such as silyl group, or the like at terminal ends, and is expressed by the following General Formula (3).

General Formula (3)

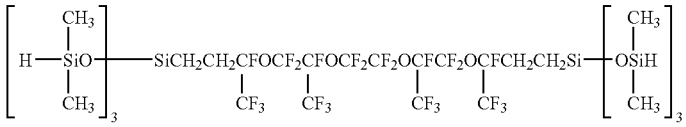

Various fillers used in a typical silicone rubber composition may be used as the filler of the (C) component. Examples of the filler include reinforcing fillers such as aerosol silica, sedimentary silica, carbon powder, titanium dioxide, aluminum oxide, quartz powder, talc, sericite and bentonite; and fibrous fillers such as asbestos, glass fiber and organic fiber.

Examples of the catalyst of the (D) component include chloroplatinic acid which has been known as a catalyst for addition reaction, alcohol modified chloroplatinic acid, a complex of chloroplatinic acid and olefin, those in which platinum black or palladium is supported on carriers such as alumina, silica and carbon, a complex of rhodium with olefin, elements of periodic table VIII group such as chlorotris (triphenyl phosphine), rhodium (Wilkinson catalyst), rhodium (III) acetylacetonate and the compounds thereof. These complexes are preferably used by dissolving in solvents such as an alcohol compound, an ether compound and a hydrocarbon compound.

There are no particular restrictions on the fluorocarbon siloxane rubber composition, and any composition may be appropriately used according to the intended use. Various compounding agents may be added. Examples of the compounding agents include dispersing agents such as diphenylsilanediol, low-polymerized molecular chain hydroxyl-end-blocked dimethylpolysiloxane and hexamethyldisilazane; heat-resistance improving agents such as ferrous oxide, ferric oxide, ceric oxide and iron octylate; and colorants such as pigments.

The belt member is obtained by coating a surface of the support film with the fluorocarbon siloxane rubber composition, and heating and curing. Moreover, the belt member is obtained by diluting the fluorocarbon siloxane rubber composition with a solvent such as m-xylene hexafluoride and benzotrifluoride to prepare a coating solution, and coating a surface of the support film with the coating solution by using a typical coating method such as spray coating, dip coating, or knife coating, as necessary. Further, there are no particular restrictions on the heating and curing temperature and time, and any temperature and time may be appropriately selected as long as the temperatures is 100° C. to 500° C. and the time is 5 seconds to 5 hours, depending on the type and production method of the support film, and the like.

There are no particular restrictions on the thickness of the release layer to be formed on the surface of the support film. The thickness is preferably 1 μm to 200 μm and more preferably 5 μm to 150 μm in view of the fact that images with favorable fixing property are obtained by preventing the separation property of toner or offset of toner components.

Here, an example of an image forming apparatus using the image surface smoothing and fixing device used in the present invention will be specifically explained with reference to FIGS. 1 and 2.

Figure 2:
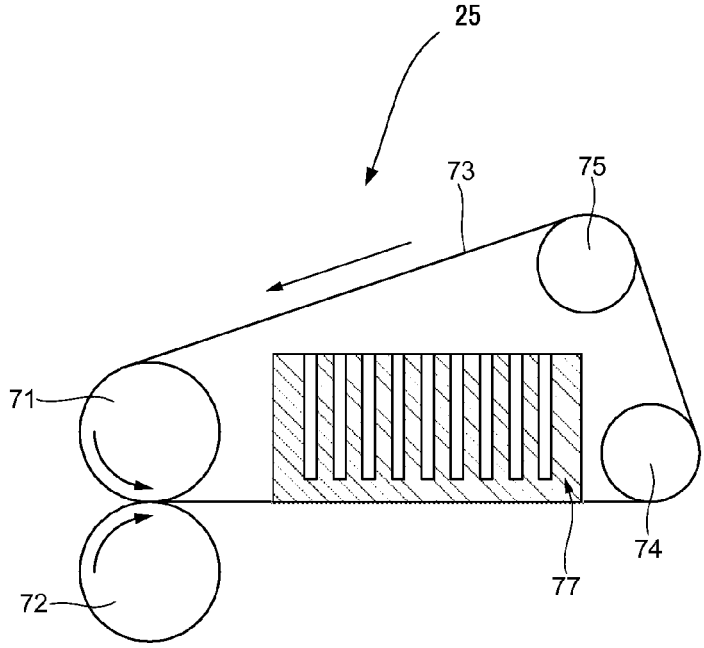
FIG. 2 is a schematic diagram showing one example of an image surface smoothing and fixing device of the image forming apparatus shown in FIG. 1.

The image surface smoothing and fixing device shown in FIG. 2 may be a device in which a fixing portion of the image forming apparatus shown in FIG. 1 (full-color laser printer, DCC-500, manufactured by Fuji Xerox Co., Ltd.) is modified.

In FIGS. 1, 200, 37, 19, 31, 18, and 25 respectively denote the image forming apparatus, a photosensitive drum, a developing unit, an intermediate transfer belt, an electrophotographic image receiving sheet and a fixing portion (image surface smoothing and fixing device).

FIG. 2 shows the fixing portion (image surface smoothing and fixing device) 25 disposed inside the image forming apparatus 200 shown in FIG. 1.

As shown in FIG. 2, the image surface smoothing and fixing device 25 is provided with a heating roll 71, an endless belt 73 which is rotationally supported by a separation roller 74 including the heating roll 71, and a tension roll 75, and a pressure roller 72 which is brought into contact under pressure with the heating roller 71 via the endless belt 73.

Moreover, a cooling heat sink 77 for forcibly cooling the endless belt 73 is disposed between the heating roller 71 and the separation roller 74 on the inner face of the endless belt 73. The cooling heat sink 77 constitutes a cooling/sheet transport portion for cooling an electrophotographic image receiving sheet and transporting the sheet.

Then, as shown in FIG. 2, in the image surface smoothing and fixing device 25, a color toner image is transferred and fixed onto a surface of an electrophotographic transfer sheet, and then is introduced to a pressure contact portion (nip portion) between the heating roller 71 and the pressure roller 72, which is brought into contact under pressure with the heating roller 71 via the endless belt 73 in such a manner that a color toner image is positioned on the heating roller 71 and passed through the pressure contact portion between the heating roller 71 and the pressure roller 72, during which the color toner image is heated, melted on the electrophotographic image receiving sheet and then fixed thereon.

Thereafter, at the pressure contact portion between the heating roller 71 and the pressure roller 72, for example, toner is heated substantially to temperature about 120° C. to 130° C., and melted, and then the electrophotographic image receiving sheet in which the color toner image is fixed on the toner image receiving layer is transported together with the endless belt 73, while the toner image receiving layer thereon is firmly attached onto the surface of the endless belt 73. In the meantime, the endless belt 73 is forcibly cooled by the cooling heat sink 77, and after the color toner image and the toner image receiving layer are cooled and solidified, the electrophotographic image receiving sheet is separated therefrom by the separation roller 74 due to its own stiffness (rigidity).

It is noted that the surface of the endless belt 73 after completion of the separating step from which residual toner and the like are removed by a cleaner (not shown) is ready for a subsequent image surface smoothing and fixing step.

The image forming method of the present invention, even when an oil-less device without using a fixing oil is used, is excellent in separation property of toner on the electrophotographic image receiving sheet, and can prevent offset of the electrophotographic image receiving sheet and toner components, thereby achieving stable paper feeding, and the image forming method exhibits excellent passing performance in a fixing device, and can form a highly glossy and high-quality image similar to that of silver halide photography.

According to the present invention, an electrophotographic image receiving sheet having excellent low temperature fixing property and excellent adhesion resistance, capable of forming a highly glossy and high-quality image similar to that of silver halide photography, and an image forming method using the electrophotographic image receiving sheet, which exhibits excellent passing performance in a fixing device, and can prevent occurrence of running failure such as jam, double feed in an image forming apparatus.

EXAMPLES

Hereinafter, the present invention will be further described in detail with reference to Examples, however, the present invention is not limited to the disclosed Examples.

<Preparation of Support>

Fine paper having a basis weight of 160 g/m$^2$ as a raw paper was used, and on a back surface thereof a mixture of high density polyethylene (HDPE) and low density polyethylene (LDPE), in which a mass ratio of HDPE to LDPE (HDPE/LDPE) was 55/45, was formed into a back surface PE layer having a thickness of 20 μm by an extrusion coating method at 320° C.

Next, on a front surface LDPE was formed into a front surface PE layer having a thickness of 30 μm in the same manner as in the back surface, thereby producing a double-sided polyethylene laminated paper.

Thereafter, the front surface was subjected to corona discharge treatment at 18 kW, and coated with a gelatin undercoat layer in dried coating amount of 0.06 g/m$^2$. On the other hand, the back surface was also subjected to corona discharge treatment at 12 kW, and coated with a back surface layer containing 0.075 g/m$^2$ of SNOWTEX (manufactured by Nissan Chemical Industries, Ltd.), 0.038 g/m$^2$ of ALUMINASOL, and 0.001 g/m$^2$ of polyvinyl alcohol, in dried coating amount. Thus, a support was prepared.

<Synthesis of Polyester Resin>

—Synthesis of Crystalline Polyester Resin C-1—

First, 253.6 g of dodecanediotic acid, 95.2 g of ethylene glycol, 0.7 g of trimethylolpropane and 0.11 g of tetra-n-butyltitanate were placed into a heat- and pressure-resistant glass container equipped with a stirrer and heated at 235° C. for three hours to conduct an esterification reaction. Then, the system gradually decreased in pressure to be 13 Pa in one hour time. Three hours later, nitrogen gas was supplied thereto so as to return the pressure to a normal pressure. Then, 10.4 g of anhydrous trimellitic acid was added thereto and stirred for 1.5 hours to conduct a depolymerization reaction, thereby synthesizing a crystalline polyester resin C-1.

—Synthesis of Crystalline Polyester Resin C-2—

A crystalline polyester resin C-2 was synthesized in the same manner as in the crystalline polyester resin C-1 with the composition shown in Table 1.

—Synthesis of Amorphous Polyester Resin A-1—

First, 166.0 g of terephthalic acid, 36.0 g of ethylene glycol, 48.9 g of neopentyl glycol and 94.8 g of 2,2-bis(4-hydroxyethoxyphenyl)propane were placed into a heat- and pressure-resistant glass container equipped with a stirrer, and heated at 260° C. for four hours to conduct an esterification reaction. Then, 79 mg of antimony trioxide and 49 mg of triethyl phosphate were added as a catalyst to increase the temperature of the system to 280° C., and the system gradually decreased in pressure to 13 Pa in one hour time. After allowing the polymerization reaction to carry out for two hours, the system was supplied with nitrogen gas to return the pressure to a normal pressure. Then, the temperature of the system was decreased to 250° C., and 8.5 g of isophthalic acid was added thereto and stirred for two hours to conduct a depolymerization reaction, thereby synthesizing an amorphous polyester resin A-1.

—Synthesis of Amorphous Polyester Resins A-2 and A-3—

Amorphous polyester resins A-2 and A-3 were respectively synthesized in the same manner as in the amorphous polyester resin A-1 with the composition shown in Table 1.

A characteristic value of each of the polyester resins in the obtained crystalline polyester resins C-1 to C-2, and amorphous polyester resins A-1 to A-3 was obtained by the following methods. The results are shown in Table 1.

(1) Composition of Polyester Resin

The composition of the polyester resin was determined by an $^1$H-NMR analyzer (300 MHz, manufactured by Varian Inc.).

(2) Number-Average Molecular Mass of Polyester Resin

The number average molecular mass of the polyester resin was determined by gel permeation analysis, using a solvent delivery unit LC-10ADvp and an ultraviolet/visible spectrophotometer SPD-6AV (manufactured by Shimadzu Corporation), under the conditions of a detection wavelength of 254 nm, tetrahydrofuran serving as a solvent, and polystyrene conversion.

(3) Acid Value of Polyester Resins

First, 0.5 g of the polyester resin was dissolved in 50 mL of water and dioxane (volume ratio of water to dioxane (water/dioxane) was 1/10), and then KOH was used to conduct titration, with cresol red used as an indicator, and an amount of KOH consumed for neutralization, in terms of mg which was converted to a value per gram of the polyester resin, was defined as an acid value.

(4) Melting Point and Glass Transition Temperature of Polyester Resin

As a sample, 10 mg of polyester resin was taken, a differential scanning calorimeter (DSC) (DSC-7 manufactured by Perkin Elmer Japan Co., Ltd.) was used to measure peaks at a temperature-increasing speed of 20° C./min, and, of the peaks derived from obtained crystals, the highest peak during the temperature increase was defined as a melting point of the polyester resin.

A glass transition temperature was measured in the same manner as in the above description, except that it was measured at the temperature-increasing speed of 10° C./min. On the obtained temperature increase curve, the value of the first curving point out of the two curving points of the temperature, which were derived from glass transition, was defined as a glass transition temperature.

TABLE 1

| | | | Crystalline polyester resin | | Amorphous polyester resin | | |
|---|---|---|---|---|---|---|---|
| | | | C-1 | C-2 | A-1 | A-2 | A-3 |
| Composition of polyester resin | Acid component (mole ratio) | DDA | 100.0 | — | — | — | — |
| | | SEA | — | 100.0 | — | — | — |
| | | TPA | — | — | 100.0 | 70.0 | 60.0 |
| | | IPA | — | — | 5.0 | 33.5 | 25.0 |
| | | ADA | — | — | — | — | 15.0 |
| | | TMA | 4.9 | 4.4 | — | — | 2.5 |
| | Alcohol component (mole ratio) | EG | 99.5 | — | 35.0 | 55.0 | 30.0 |
| | | BD | — | 99.5 | — | — | 70.0 |
| | | TMP | 0.5 | 0.5 | — | — | — |
| | | NPG | — | — | 35.0 | 45.0 | — |
| | | BAEO | — | — | 30.0 | — | — |
| Number average molecular mass | | | 8,800 | 10,000 | 6,000 | 6,000 | 7,000 |
| Melting point (° C.) | | | 81 | 65 | — | — | — |
| Glass transition temperature (° C.) | | | — | — | 70 | 62 | 41 |
| Acid value (mgKOH/g) | | | 25.0 | 30.2 | 17.1 | 17.4 | 18.1 |
| Self-dispersible water-based polyester resin emulsion | | | SC-1 | SC-2 | SA-1 | SA-2 | SA-3 |

The abbreviations shown in Table 1 have the following meanings:

* DDA: dodecanediotic acid, SEA: sebacic acid, TPA: terephthalic acid, IPA: isophthalic acid, ADA: adipic acid, TMA: trimellitic acid, EG: ethylene glycol, BD: 1,4-butanediol, TMP: trimethylol propane, NPG: neopentyl glycol, BAEO: 2,2-bis(4-hydroxyethoxyphenyl)propane <Production of Self-Dispersible Water-Based Polyester Resin Emulsion>

—Preparation of Self-Dispersible Water-Based Crystalline Polyester Resin Emulsion SC-1—

Firstly, 200 g of the crystalline polyester resin C-1 and 467 g of methyl ethyl ketone were placed into a 3-liter 3-neck round-bottom flask, which was immersed into a hot-water bath at 60° C., and dissolved by using a stirrer until the resultant became a transparent solution. While the solution was kept heated and stirred, 27 g of triethylamine was added as a basic compound thereto, and 653 g of distilled water was then added gradually, with attention paid to a homogenous system, so as to subject the resultant to phase inversion and emulsification. Then, the flask was transferred to an oil bath at 85° C., to which a cooling tube was attached, and methyl ethyl ketone was boiled together with water, with stirring to distill out. Depending on a distillation state, the oil bath was heated finally up to 120° C. While a mass of a distilled solution was measured, the heating was stopped at the time when the mass of the distilled solution reached 680.3 g, and the system was cooled to room temperature in a water bath. Then, 2.6 g of ammonia water (28% by mass) was added and stirred, and liquid components inside the flask were filtered by using a 600-mesh filter to prepare a "self-dispersible water-based crystalline polyester resin emulsion SC-1".

The emulsion was analyzed and found that the emulsion had a solid content concentration of 30.0% by mass, a viscosity of 7.0 mPa·s, a methyl ethyl ketone content of 0.1% by mass, pH of 9.1, and a volume average particle diameter of 228 nm.

[Measurement of Solid Content Concentration]

The solid content concentration of the polyester resin in the self-dispersible water-based polyester resin emulsion was obtained in such a manner that 1 g of the self-dispersible water-based polyester resin emulsion was weighed and heated at 150° C., until a mass of a residue (solid content) reached constant mass.

[Measurement of Volume Average Particle Diameter]

The volume average particle diameter of the polyester resin in the self-dispersible water-based polyester resin emulsion was measured by using MICROTRAC particle size analyzer UPA150 (MODEL No. 9340) available from NIKKISO CO., LTD.

—Preparation of Self-Dispersible Water-Based Crystalline Polyester Resin Emulsion SC-2—

A "self-dispersible water-based crystalline polyester resin emulsion SC-2" was obtained in the same manner as in the "self-dispersible water-based crystalline polyester resin emulsion SC-1", except that the "crystalline polyester resin C-2", 33 g of triethylamine, and 0.9 g of ammonia water (28% by mass) added in the final stage was used. The prepared "self-dispersible water-based crystalline polyester resin emulsion SC-2" had a solid content concentration of 30.0% by mass, and a volume average particle diameter of 198 nm.

—Preparation of Self-Dispersible Water-Based Amorphous Polyester Resin Emulsion SA-1—

Firstly, 558.4 g of water, 135.0 g of isopropyl alcohol, 300 g of the "amorphous polyester resin A-1" and 6.4 g of ammonia water (28% by mass) were placed into a 3-liter 3-neck round-bottom flask, which was immersed into a hot-water bath and heated to an internal temperature of 70° C., with stirring. One hour later, 113.6 g of water was added to the system, while heating and stirring. Then, a cooling tube was attached to the flask, the hot-water bath was heated to 85° C., and isopropyl alcohol was boiled together with water for distillation. Depending on the distillation state, an oil bath was heated finally up to 120° C. While a mass of a distilled solution was measured, the heating was stopped at the time when the mass of the distilled solution reached 256.5 g, and the system was cooled to room temperature in a water bath. Then, liquid components inside the flask were filtered by using a 600-mesh filter to prepare a "self-dispersible water-based amorphous polyester resin emulsion SA-1" having a solid content concentration of 30.0% by mass and a volume average particle diameter of 150 nm.

—Preparation of Self-Dispersible Water-based Amorphous Polyester Resin Emulsions SA-2 and SA-3—

"Self-dispersible water-based amorphous polyester resin emulsions SA-2 and SA-3" were respectively prepared in the same manner as in the "self-dispersible water-based amorphous polyester resin emulsion SA-1", except that the "amorphous polyester resin A-1" was respectively replaced with "amorphous polyester resin A-2" and "amorphous polyester resin A-3". The prepared "self-dispersible water-based amorphous polyester resin emulsion SA-2" had a solid content concentration of 30.0% by mass and a volume average particle diameter of 130 nm, and the "self-dispersible water-based amorphous polyester resin emulsion SA-3" had a solid content concentration of 30.0% by mass and a volume average particle diameter of 160 nm.

<Preparation of Titanium Dioxide Dispersion>

The following components were mixed and dispersed by using a disperser NBK-2 (manufactured by Nissei Corporation) to prepare a dispersion liquid of titanium dioxide containing 40% by mass of a titanium dioxide pigment.

| | |
|---|---|
| Titanium dioxide (TIPAQUE A-220, manufactured by Ishihara Sangyo Kaisha Ltd.) | 40.0 g |
| Polyvinyl alcohol (PVA 205C, manufactured by Kuraray Co., Ltd.) | 5.0 g |
| Surfactant (DEMOL EP, manufactured by Kao Corporation) | 0.1 g |
| Ion exchanged water | 55.0 g |

<Production of Electrophotographic Image Receiving Sheet>

Example 1

A coating solution for a toner image receiving layer 1, a coating solution for a toner image receiving layer 2, and a coating solution for an intermediate layer, described below were respectively filtered by using a 400-mesh filter (effective filtration accuracy: 40 μm or less), and the front surface of the support was simultaneously coated with 3.75 g/m$^2$ of the coating solution for the toner image receiving layer 1, 3.75 g/m$^2$ of the coating solution for the toner image receiving layer 2, and 5.0 g/m$^2$ of the coating solution for the intermediate layer in this order from top, in dried coating amount, using a slide coater, so as to form a multilayer. Then, these layers were dried by hot air at 100° C. for about 20 seconds, thereby producing an electrophotographic image receiving sheet of Example 1. After drying, the toner image receiving layer 1, the toner image receiving layer 2, and the intermediate layer respectively had a thickness of 3.75 μm, 3.75 μm and 5 μm.

—Preparation of Coating Solution for Toner Image Receiving Layer 1—

The coating solution for the toner image receiving layer 1 was prepared by mixing the following compositions.

| | |
|---|---|
| The self-dispersible water-based crystalline polyester resin emulsion SC-1 (the crystalline polyester resin C-1, solid content: 30% by mass) | 33 g (solid content: 10 g) |
| The self-dispersible water-based amorphous polyester resin emulsion SA-1 (the amorphous polyester resin A-1, solid content: 30% by mass) | 300 g (solid content: 90 g) |
| Water | 90 g |
| The titanium dioxide dispersion liquid described above | 25 g |
| Carnauba wax aqueous dispersion (SEROSOL 524, manufactured by Chukyo Yushi Co., Ltd., solid content: 30% by mass): | 33 g (solid content: 10 g) |
| Polyethylene oxide (ALKOX R-1000, manufactured by Meisei Chemical Works, Ltd.) | 10 g |
| Anionic surfactant (RAPISOL A90, manufactured by NOF Corporation | 2.5 g |

—Preparation of Coating Solution for Toner Image Receiving Layer 2—

The coating solution for the toner image receiving layer 2 was prepared in the same manner as in the coating solution for the toner image receiving layer 1, except that the amount of the self-dispersible water-based crystalline polyester resin emulsion SC-1 was 167 g (solid content: 50 g), and the amount of the self-dispersible water-based amorphous polyester resin emulsion SA-1 was 167 g (solid content: 50 g).

—Preparation of Coating Solution for Intermediate Layer—

The coating solution for the intermediate layer was prepared by mixing the following compositions.

| | |
|---|---|
| Water dispersed acryl resin emulsion (HIROS HE-1335, manufactured by Seiko PMC Corporation, solid content: 45% by mass, glass transition temperature: 15° C.) | 100 g (solid content: 45 g) |
| Polyethylene oxide (ALKOX R-1000, manufactured by Meisei Chemical Works, Ltd.) | 1 g |
| Anionic surfactant (RAPISOL A-90, manufactured by NOF Corporation) | 0.6 g |
| Water | 30 g |

Examples 2 to 6

Each of electrophotographic image receiving sheets of Examples 2 to 6 was produced in the same manner as in Example 1, except that the ratios of SC-1 and SA-1 in the coating solution for the toner image receiving layer 1 and the coating solution for the toner image receiving layer 2 in Example 1 were respectively replaced with a mixture mass ratio M (which was described in a solid content ratio of the crystalline polyester resin C-1 and that of the amorphous polyester resin A-1) shown in Table 2-1.

Example 7

An electrophotographic image receiving sheet of Example 7 was produced in the same manner as in Example 1, except that a coating solution for a toner image receiving layer 3 was added, and the front surface of the support was simultaneously coated with 2.5 g/m$^2$ of the coating solution for the toner image receiving layer 1, 2.5 g/m$^2$ of the coating solution for the toner image receiving layer 2, 2.5 g/m$^2$ of the coating solution for the toner image receiving layer 3 and 5.0 g/m$^2$ of the coating solution for the intermediate layer in this order from top, in dried coating amount, so as to form a multilayer.

—Preparation of Coating Solution for Toner Image Receiving Layer 3—

The coating solution for the toner image receiving layer 3 was prepared in the same manner as in the coating solution for the toner image receiving layer 1, except that the self-dispersible water-based crystalline polyester resin emulsion SC-1 was not used, and the amount of the self-dispersible water-based amorphous polyester resin emulsion SA-1 was 333 g (solid content: 100 g).

Example 8

An electrophotographic image receiving sheet 8 was produced in the same manner as in Example 7, except that the ratios of SC-1 and SC-2 in the coating solution for the toner image receiving layer 2 and the coating solution for the toner image receiving layer 3 were changed to the mixture mass ratio M described in Table 2-1.

Example 9

An electrophotographic image receiving sheet of Example 9 was produced in the same manner as in Example 7, except that the front surface of the support was simultaneously coated with 2.5 g/m$^2$ of the coating solution for the toner image receiving layer 1, 1.5 g/m$^2$ of the coating solution for the toner image receiving layer 3, 3.5 g/m$^2$ of the coating solution for the toner image receiving layer 2 and 5.0 g/m$^2$ of the coating solution for the intermediate layer in this order from top, in dried coating amount, so as to form a multilayer.

Examples 10 to 12

Each of electrophotographic image receiving sheets of Examples 10 to 12 was produced in the same manner as in Example 1, except that the self-dispersible water-based crystalline polyester resin emulsions and the self-dispersible water-based amorphous polyester resin emulsions of the coating solution for the toner image receiving layer 1 and the coating solution for the toner image receiving layer 2 were respectively replaced with the combinations of emulsions shown in Table 2-1.

Example 13

An electrophotographic image receiving sheet of Example 13 was produced in the same manner as in Example 1, except that the coating solution for the toner image receiving layer 1 and the coating solution for the toner image receiving layer 2 were respectively 1.88 g/m$^2$ and 5.62 g/m$^2$, in dried coating amount.

Example 14

An electrophotographic image receiving sheet of Example 14 was produced in the same manner as in Example 1, except that the coating solution for the toner image receiving layer 1 and the coating solution for the toner image receiving layer 2 were respectively 5.62 g/m$^2$ and 1.88 g/m$^2$, in dried coating amount.

Example 15

An electrophotographic image receiving sheet of Example 15 was produced in the same manner as in Example 1, except that the coating solution for the toner image receiving layer 1 and the coating solution for the toner image receiving layer 2 were respectively 1.88 g/m$^2$ and 3.75 g/m$^2$, in dried coating amount.

Example 16

An electrophotographic image receiving sheet of Example 16 was produced in the same manner as in Example 1, except that the coating solution for the toner image receiving layer 1 and the coating solution for the toner image receiving layer 2 were respectively 5.62 g/m$^2$ and 5.62 g/m$^2$, in dried coating amount.

Comparative Example 1

A coating solution for a toner image receiving layer 4 described below and the coating solution for the intermediate layer of Example 1 were respectively filtered by using a 400-mesh filter (effective filtration accuracy: 40 μm or less), and the front surface of the support was simultaneously coated with 7.5 g/m$^2$ of the coating solution for the toner image receiving layer 4, and 5.0 g/m$^2$ of the coating solution for the intermediate layer of Example 1 in this order from top, in dried coating amount, using a slide coater, so as to form a multilayer. Thereafter, the layers were dried in the same manner as in Example 1, thereby producing an electrophotographic image receiving sheet of Comparative Example 1.

—Preparation of Coating Solution for Toner Image Receiving Layer 4—

The coating solution for the toner image receiving layer 4 was prepared by mixing the following compositions.

| | |
|---|---|
| The self-dispersible water-based amorphous polyester resin emulsion SA-1 (the amorphous polyester resin A-1, solid content: 30% by mass) | 333 g (solid content: 100 g) |
| Water | 90 g |
| The titanium dioxide dispersion liquid described above | 25 g |
| Carnauba wax aqueous dispersion (SEROSOL 524, manufactured by Chukyo Yushi Co., Ltd., solid content: 30% by mass) | 33 g (solid content: 10 g) |
| Polyethylene oxide (ALKOX R-1000, manufactured by Meisei Chemical Works, Ltd.) | 10 g |
| Anionic surfactant (RAPISOL A90, manufactured by NOF Corporation) | 2.5 g |

Comparative Example 2

An electrophotographic image receiving sheet of Comparative Example 2 was produced in the same manner as in Comparative Example 1, except that the self-dispersible water-based amorphous polyester resin emulsion SA-1 was replaced with SA-3.

Comparative Example 3

An electrophotographic image receiving sheet of Comparative Example 3 was produced in the same manner as in Comparative Example 1, except that the coating solution for the toner image receiving layer 4 was replaced with the coating solution for the toner image receiving layer 1 of Example 1.

Comparative Examples 4 to 5

Each of electrophotographic image receiving sheets of Comparative Examples 4 to 5 was produced in the same manner as in Comparative Example 3, except that the mixture mass ratio M of SC-1 and SA-1 in the coating solution for the toner image receiving layer 1 of Comparative Example 3 was respectively replaced with a mixture mass ratio M (which was described in a solid content ratio of crystalline polyester resin C-1 and that of amorphous polyester resin A-1) shown in Table 2-1.

Comparative Examples 6 to 7

Each of electrophotographic image receiving sheets of Comparative Examples 6 to 7 was produced in the same manner as in Example 1, except that the mixture mass ratios M of SC-1 and SA-1 of the coating solution for the toner image receiving layer 1 and the coating solution for the toner image receiving layer 2 were respectively replaced with the mixture mass ratios M shown in Table 2-1.

Comparative Example 8

An electrophotographic image receiving sheet of Comparative Example 8 was produced in the same manner as in Example 7, except that the front surface of the support was simultaneously coated with 2.5 g/m$^2$ of the coating solution for the toner image receiving layer 2, 2.5 g/m$^2$ of the coating solution for the toner image receiving layer 3, 2.5 g/m$^2$ of the coating solution for the toner image receiving layer 1 and 5.0 g/m$^2$ of the coating solution for the intermediate layer in this order from top, in dried coating amount, so as to form a multilayer.

Comparative Example 9

An electrophotographic image receiving sheet of Comparative Example 9 was produced in the same manner as in Comparative Example 8, except that the coating solution for the toner image receiving layer 3 was replaced with a coating solution for a toner image receiving layer 5.

—Preparation of Coating Solution for Toner Image Receiving Layer 5—

The coating solution for the toner image receiving layer 5 was produced in the same manner as in the coating solution for the toner image receiving layer 1, except that the amount of the self-dispersible water-based crystalline polyester resin emulsion SC-1 and the amount of the self-dispersible water-based amorphous polyester resin emulsion SA-1 were respectively 100 g (solid content: 30 g) and 233 g (solid content: 70 g).

Next, low temperature fixing property (edge void (EV)), image quality (gloss), adhesion resistance and passing performance in a fixing device of the produced electrophotographic image receiving sheets of Examples 1 to 16 and Comparative Examples 1 to 9 were respectively evaluated by the following method. The results are shown in Table 2-2.

<Image Formation Condition>

By using a color laser printer (DOCU CENTRE COLOR 500CP, manufactured by Fuji Xerox Co., Ltd.) shown in FIG. 1, in which a fixing portion was modified so that an image sample which had not been fixed was out put, an unfixed image sample, in which a toner image was transferred to each of the thus prepared electrophotographic image receiving sheets, was out put, and then the transferred image was fixed on a surface of the sheet which faced upward, at 23° C. and 55% RH under the following conditions, using the image surface smoothing and fixing device shown in FIG. 2.

—Belt—

Support of belt: Polyimide (PI) film 50 cm in width and 80 μm in thickness

Material for release layer of the belt: SIFEL 610 (manufactured by Shin-Etsu Chemical Co., Ltd.), or a precursor of fluorocarbon siloxane rubber, was vulcanized and cured to form a 50 μm-thick fluorocarbon siloxane rubber layer.

—Heating and Pressurizing Step—

Temperature of heating roller: optionally appropriately adjustable

Nip pressure: 130 N/cm$^2$

—Cooling Step—

Cooler: length of heat sink of 80 mm

Speed: 20 mm/sec.

<Evaluation of Low Temperature Fixing Property (Edge Void)>

An image forming apparatus (DOCUCENTRE COLOR 500CP), in which a fixing-portion had been modified, was used to output black x marks (a longitudinal image consisting of 5 x marks in 1.8 cm square, where "A cm square" means A cm long and A cm wide) and to output red x marks in the same manner, respectively left above and right below on A4-size paper. Thereafter, the images were fixed by the image surface smoothing and fixing device, with the temperature of the heating roller set at 120° C. The degree of defects occurring on the boundary line between a toner image portion and a non-image portion of printed samples after fixation were visually observed and evaluated (dents at an edge portion: edge void (EV)) according to the following criteria. Values evaluated for the red and black marks given left above and right below were averaged. It is noted that the criteria of "C" or higher (2 or less) are desirable for practical use in the present invention.

[Evaluation Criteria]

0 (A): No visual dents are found.

1 (B): Dents are found in half of the x marks in spots.

2 (C): Dents are found in all the x marks in spots.

3 (D to C): Dents are found in all the x marks, with a length up to approximately 2 mm.

4 (D): Dents are found in all the x marks, with a length up to approximately 5 mm.

<Evaluation of Image Quality (Gloss)>

The image forming apparatus used in the evaluation of low temperature fixing property (edge void) was used to output images of 1.8 cm square in size at six concentration levels (0%, 20%, 40%, 60%, 80% and 100%) under black/white conditions on each of the electrophotographic image receiving sheets. Thereafter, the images were fixed by using the image surface smoothing and fixing device, with the temperature of a heating roller set at 125° C. The thus respective obtained images at six concentration levels were measured for the gloss level at 20 degrees by using a micro-TRI-gloss (manufactured by BYK Gardner GmbH), and the minimum values were recorded. It is noted that the criteria of B or higher are desirable for practical use in the present invention.

[Evaluation Criteria]

A: Gloss level of 75 or more; excellent (useful as a high quality image recording material)

B: Gloss level of 70 or more: good (useful as a high quality image recording material)

C: Gloss level of 60 or more: passable (allowable as a high quality image recording material)

D: Gloss level of less than 60: poor (not allowable as a high quality image recording material)

<Evaluation of Adhesion Resistance>

The electrophotographic image receiving sheets produced in Examples 1 to 16 and Comparative Examples 1 to 9 were stored for 24 hours at 40° C. and 80% RH, and then one electrophotographic image receiving sheet was superposed with another electrophotographic image receiving sheet so that a surface of a toner image receiving layer of the one electrophotographic image receiving sheets faced a back surface of another electrophotographic image receiving sheet, and a load of 3.5 cm square×500 g was applied thereto. After being allowed to stand for 3 days under the same conditions, the electrophotographic image receiving sheets were separated from each other. The separation state was evaluated based on the following criteria. It is noted that the criteria of B or higher are desirable for practical use in the present invention.

[Evaluation Criteria]

A: Neither separation sound nor adhesion mark is found on separation.

B: Slight separation sound or adhesion mark is found on separation.

C: Adhesion mark remains by less than ¼ on separation.

D: Adhesion mark remains by ¼ or more and less than ½ on separation.

E: Adhesion mark remains by ½ or more on separation.

<Evaluation of Passing Performance in Fixing Device>

Figure 3:
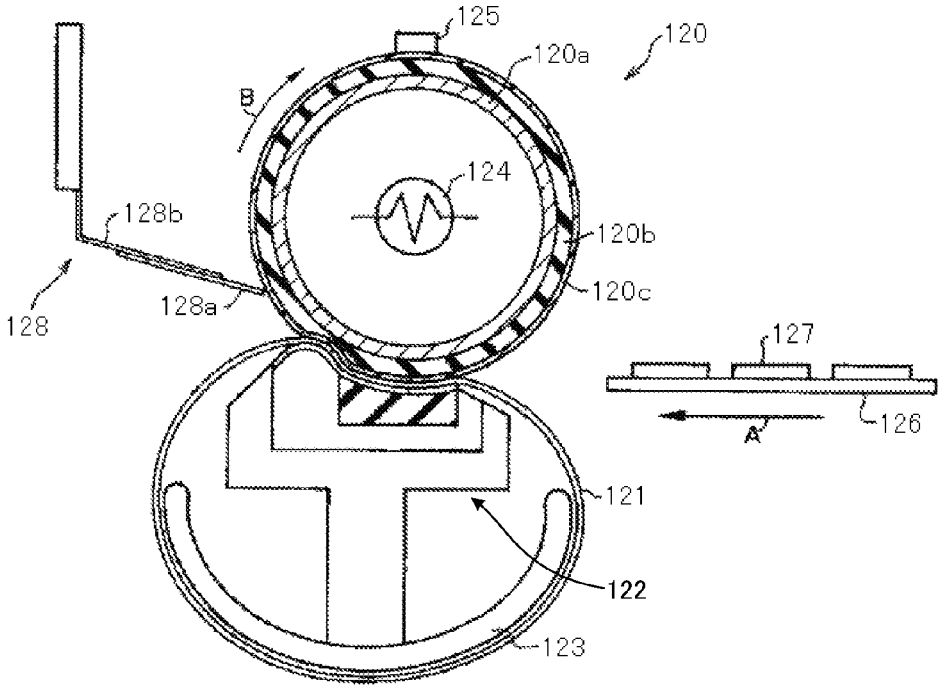
FIG. 3 is a fixing device used for evaluation passing performance in a fixing device in Examples.

By the use of the fixing device shown in FIG. 3, which was set at a feeding speed of 52 mm/sec and a temperature of a fixing roller of 150° C., electrophotographic image receiving sheets of each examples in a postcard size were passed through the fixing device by 5 sheets at 23° C. and 55% RH, with the toner image receiving layer facing the side brought into contact with the fixing roller. The passing performance in a fixing device was evaluated based on the criteria described below.

Here, the fixing device shown in FIG. 3 includes a fixing roller 120, an endless belt 121, a pressing pad 122 which is pressed against the fixing roller 120 via the endless belt 121, and a separation unit 128. The fixing roller 120 includes a heat resistant elastic layer 120*b* and a release layer 120*c*, which are formed around a metal core 120*a*. The electrophotographic image receiving sheet 126 after fixing is not wound around the fixing roller 120 but suitably separated therefrom owing to the effect of distortion in the release layer 120*c* and a nip portion. In order to assist the separation, a separation unit 128 is provided in the downstream of the nip portion in the rotational direction of the fixing roller 120. The structure of the separation unit 128 is such that a separation sheet 128*a* is held by a guide 128*b* and in contact with the fixing roller 120 in an opposite direction (reverse direction) to the rotational direction of the fixing roller 120. In FIG. 3, 125 denotes a temperature sensor and 127 denotes a toner image.

[Evaluation Criteria]

A: All five sheets pass through the fixing device.

B: At least one of five sheets is wound around the fixing roller and does not pass through the fixing device.

TABLE 2-1

| | | | Mixture mass ratio of crystalline polyester and amorphous polyester of toner image receiving layer: M | | | Thickness of toner image receiving layer (μm) | | |
|---|---|---|---|---|---|---|---|---|
| | Crystalline polyester emulsion | Amorphous polyester emulsion | Image receiving layer 1 (outer layer) | Image receiving layer 2 (inner layer) | Image receiving layer 3 (inner-most layer) | Image receiving layer 1 (outer layer) | Image receiving layer 2 (inner layer) | Image receiving layer 3 (inner-most layer) |
| Ex. 1 | SC-1 | SA-1 | 0.1 | 0.5 | — | 3.75 μm | 3.75 μm | — |
| Ex. 2 | SC-1 | SA-1 | 0 | 0.5 | — | 3.75 μm | 3.75 μm | — |
| Ex. 3 | SC-1 | SA-1 | 0.3 | 0.5 | — | 3.75 μm | 3.75 μm | — |
| Ex. 4 | SC-1 | SA-1 | 0.1 | 0.75 | — | 3.75 μm | 3.75 μm | — |
| Ex. 5 | SC-1 | SA-1 | 0.1 | 1.0 | — | 3.75 μm | 3.75 μm | — |
| Ex. 6 | SC-1 | SA-1 | 0 | 1.0 | — | 3.75 μm | 3.75 μm | — |
| Ex. 7 | SC-1 | SA-1 | 0.1 | 0.5 | 0 | 2.5 μm | 2.5 μm | 2.5 μm |
| Ex. 8 | SC-1 | SA-1 | 0.1 | 0.3 | 0.5 | 2.5 μm | 2.5 μm | 2.5 μm |
| Ex. 9 | SC-1 | SA-1 | 0.1 | 0 | 0.5 | 2.5 μm | 1.5 μm | 3.5 μm |
| Ex. 10 | SC-2 | SA-1 | 0.1 | 0.5 | — | 3.75 μm | 3.75 μm | — |
| Ex. 11 | SC-1 | SA-2 | 0.1 | 0.5 | — | 3.75 μm | 3.75 μm | — |
| Ex. 12 | SC-1 | SA-3 | 0.1 | 0.5 | — | 3.75 μm | 3.75 μm | — |
| Ex. 13 | SC-1 | SA-1 | 0.1 | 0.5 | — | 1.88 μm | 5.62 μm | — |
| Ex. 14 | SC-1 | SA-1 | 0.1 | 0.5 | — | 5.62 μm | 1.88 μm | — |
| Ex. 15 | SC-1 | SA-1 | 0.1 | 0.5 | — | 1.88 μm | 3.75 μm | — |
| Ex. 16 | SC-1 | SA-1 | 0.1 | 0.5 | — | 5.62 μm | 5.62 μm | — |
| Comp. Ex. 1 | — | SA-1 | 0 | — | — | 7.5 μm | — | — |
| Comp. Ex. 2 | — | SA-3 | 0 | — | — | 7.5 μm | — | — |
| Comp. Ex. 3 | SC-1 | — | 0.1 | — | — | 7.5 μm | — | — |
| Comp. Ex. 4 | SC-1 | — | 0.5 | — | — | 7.5 μm | — | — |
| Comp. Ex. 5 | SC-1 | — | 0.9 | — | — | 7.5 μm | — | — |
| Comp. Ex. 6 | SC-1 | SA-1 | 0.3 | 0.1 | — | 3.75 μm | 3.75 μm | — |
| Comp. Ex. 7 | SC-1 | SA-1 | 0.5 | 0.3 | — | 3.75 μm | 3.75 μm | — |
| Comp. Ex. 8 | SC-1 | SA-1 | 0.5 | 0 | 0.1 | 2.5 μm | 2.5 μm | 2.5 μm |
| Comp. Ex. 9 | SC-1 | SA-1 | 0.5 | 0.3 | 0.1 | 2.5 μm | 2.5 μm | 2.5 μm |

* mixture mass ratio M = [A/(A + B)], where A represents a mass of the crystalline polyester (g), and B represents a mass of the amorphous polyester (g).

TABLE 2-2

| | low temperature fixing property (EV at 120° C.) | Gloss (Gloss at 20 degrees) | Adhesion resistance (Dry) | Passing performance in fixing device (at 150° C.) |
|---|---|---|---|---|
| Ex. 1 | 1.2 | B to A | A | A |
| Ex. 2 | 1.3 | A | A | A |
| Ex. 3 | 0.8 | B | A | A |
| Ex. 4 | 1.2 | B to A | A | A |
| Ex. 5 | 1.0 | B | A | A |
| Ex. 6 | 1.0 | B | A | A |
| Ex. 7 | 1.5 | B to A | A | A |
| Ex. 8 | 1.5 | B to A | A | A |
| Ex. 9 | 1.5 | B to A | A | A |
| Ex. 10 | 1.0 | B | B | A |
| Ex. 11 | 1.2 | B | A | A |
| Ex. 12 | 1.0 | B | B | A |
| Ex. 13 | 1.2 | B | A | A |
| Ex. 14 | 1.5 | A | A | A |
| Ex. 15 | 1.7 | B | A | A |
| Ex. 16 | 1.5 | A | A | A |
| Comp. Ex. 1 | 3.8 | A | A | A |
| Comp. Ex. 2 | 1.5 | B to A | E | A |
| Comp. Ex. 3 | 3.0 | A | A | A |
| Comp. Ex. 4 | 0.8 | D | A | B |
| Comp. Ex. 5 | Evaluation could not be performed. | | A | B |
| Comp. Ex. 6 | 2.5 | B | A | A |
| Comp. Ex. 7 | 1.2 | D | A | B |
| Comp. Ex. 8 | 1.5 | D | A | B |
| Comp. Ex. 9 | 1.2 | D | A | B |

* "Evaluation could not be performed." means that the sheet was not separated from the image surface smoothing and fixing device and the low temperature fixing property and gloss could not be evaluated.

As can be seen from the results of Tables 2-1 and 2-2, Examples 1 to 16 satisfy the relation: M1<M2, where M1 represents a mixture mass ratio of the outermost toner image receiving layer, and M2 represents a mixture mass ratio of a highest inner toner image receiving layer, which has the highest mixture mass ratio among the inner toner image receiving layers located inside the outermost toner image receiving layer, and have excellent results of the low temperature fixing property (edge void (EV)), image quality (gloss), adhesion resistance and passing performance in a fixing device.

INDUSTRIAL APPLICABILITY

An electrophotographic image receiving sheet of the present invention can be produced by coating of an aqueous coating solution and at low cost, causing less impact on the environment, and has excellent low temperature fixing property, excellent adhesion resistance, and favorable passing performance in a fixing device, thereby preventing occurrence of running failure such as jam, double feed in an image forming apparatus. Therefore, the electrophotographic image receiving sheet of the present invention can be used in various image forming apparatus, and form a highly glossy and high-quality image similar to that of a silver halide photographic print.

The invention claimed is:

1. An electrophotographic image receiving sheet comprising:

a support; and at least two toner image receiving layers formed over at least one surface of the support, wherein a mixture mass ratio M of a crystalline polymer and an amorphous polymer in each of the toner image receiving layers is defined as [A/(A+B)], where A represents a mass of the crystalline polymer (g), and B represents a mass of the amorphous polymer (g), and a mixture mass ratio M1 of the outermost toner image receiving layer which is located farthest from the support, and a mixture mass ratio M2 of the highest inner toner image receiving layer, which has the highest mixture mass ratio among the inner toner image receiving layers located under the outermost toner image receiving layer, satisfy the relation: M1<M2.

2. The electrophotographic image receiving sheet according to claim 1, wherein the mixture mass ratio M1 of the outermost toner image receiving layer is 0.4 or less.

3. The electrophotographic image receiving sheet according to claim 1, wherein in the case where the toner image receiving layers have a two layer structure, in which a second toner image receiving layer is formed on the support and a first toner image receiving layer is formed on the second toner image receiving layer, the mixture mass ratio M1 of the first toner image receiving layer and a mixture mass ratio M2 of the second toner image receiving layer satisfy the relation: M1<M2.

4. The electrophotographic image receiving sheet according to claim 1, wherein in the case where the toner image receiving layers have a three layer structure, in which a third toner image receiving layer is formed on the support, a second toner image receiving layer is formed on the third toner image receiving layer and a first toner image receiving layer is formed on the second toner image receiving layer, the mixture mass ratio M1 of the first toner image receiving layer, a mixture mass ratio M2 of the second toner image receiving layer and a mixture mass ratio M3 of a third toner image receiving layer satisfy the relation: M1<M2 or M1<M3 (where M1 is smaller than any one of M2 and M3, whichever larger).

5. The electrophotographic image receiving sheet according to claim 1, wherein the toner image receiving layer is formed of a coating solution for the toner image receiving layer, which comprises at least any one of a crystalline polymer aqueous dispersion containing at least the crystalline polymer and an amorphous polymer aqueous dispersion containing at least the amorphous polymer.

6. The electrophotographic image receiving sheet according to claim 1, wherein the crystalline polymer is a crystalline polyester resin and the amorphous polymer is an amorphous polyester resin.

7. The electrophotographic image receiving sheet according to claim 6, wherein the polyester resin is a carboxyl group-containing self-dispersible polyester resin.

8. The electrophotographic image receiving sheet according to claim 1, wherein the support comprises a raw paper, and at least one polyolefin resin layer formed on both surfaces of the raw paper.

9. The electrophotographic image receiving sheet according to claim 1, wherein the electrophotographic image receiving sheet further comprises an intermediate layer formed between the support and the toner image receiving layers, and the intermediate layer comprises a polymer for the intermediate layer, which has a glass transition temperature equal to or lower than a temperature for fixing an image.

10. An image forming method comprising:

forming a toner image on an electrophotographic image receiving sheet; and smoothing and fixing a surface of the toner image formed on the electrophotographic image receiving sheet, wherein the electrophotographic image receiving sheet comprises:

a support; and at least two toner image receiving layers formed over at least one surface of the support, wherein a mixture mass ratio M of a crystalline polymer and an amorphous polymer in each of the toner image receiving layers is defined as [A/(A+B)], where A represents a mass of the crystalline polymer (g), and B represents a mass of the amorphous polymer (g), and a mixture mass ratio M1 of the outermost toner image receiving layer which is located farthest from the support, and a mixture mass ratio M2 of the highest inner toner image receiving layer, which has the highest mixture mass ratio among the inner toner image receiving layers located under the outermost toner image receiving layer, satisfy the relation: M1<M2.

11. The image forming method according to claim 10, wherein the smoothing and fixing is heating and pressurizing, and cooling and separating the electrophotographic image receiving sheet on which the toner image is formed, by using an image surface smoothing and fixing device having a heating and pressurizing member, a belt member and a cooling unit.

* * * * *